US006199297B1

(12) United States Patent
Wisniewski

(10) Patent No.: US 6,199,297 B1
(45) Date of Patent: Mar. 13, 2001

(54) LYOPHILIZATION APPARATUS AND METHODS

(75) Inventor: Richard Wisniewski, San Mateo, CA (US)

(73) Assignee: Integrated Biosystems, Inc., Benicia, CA (US)

( * ) Notice: Subject to any disclaimer, the term of this patent is extended or adjusted under 35 U.S.C. 154(b) by 0 days.

(21) Appl. No.: 09/241,745

(22) Filed: Feb. 1, 1999

(51) Int. Cl.[7] ..... F26B 5/06

(52) U.S. Cl. ..... 34/284; 34/92; 34/242; 206/439; 220/367.1

(58) Field of Search ..... 34/284, 289, 92, 34/237, 242; 206/5, 6, 219, 220, 221, 439, 484.1, 524.8; 222/254, 256, 307, 311; 215/249, 251, 263, 264; 53/403, 432; 220/366.1, 367.1, 371, 373

(56) References Cited

U.S. PATENT DOCUMENTS

| | | | | |
|---|---|---|---|---|
| 3,574,950 | * | 4/1971 | Dantoni | 34/92 |
| 4,035,924 | * | 7/1977 | Faure | 34/92 X |
| 4,445,550 | * | 5/1984 | Davis et al. | 141/329 |
| 4,848,801 | * | 7/1989 | Reil | 222/528 |
| 5,015,374 | * | 5/1991 | Mathieu et al. | 210/232 |
| 5,084,040 | * | 1/1992 | Sutter | 604/403 |
| 5,325,999 | * | 7/1994 | Gueret | 222/212 |
| 5,522,155 | * | 6/1996 | Jones | 34/286 |
| 5,779,109 | * | 7/1998 | Gueret | 222/494 |
| 5,819,964 | * | 10/1998 | Grimard | 215/249 |
| 6,030,632 | * | 2/2000 | Sawan et al. | 424/405 |

FOREIGN PATENT DOCUMENTS

| | | | |
|---|---|---|---|
| 0 377 355 | 7/1998 | (EP) | B65D/51/24 |
| 2 096 680 | 2/1972 | (FR) . | |
| 2 273 721 | 6/1974 | (FR) | B65D/41/58 |
| WO 94/06705 | 3/1994 | (WO) | B65D/81/20 |

OTHER PUBLICATIONS

Hashimoto, S.; "Patent Abstract of Japan"; vol. 5, No. 35; JP 55 159776; Mar. 5, 1981, abstract.

* cited by examiner

*Primary Examiner*—Stephen Gravini
(74) *Attorney, Agent, or Firm*—Wilson Sonsini Goodrich & Rosati; David J. Abraham

(57) ABSTRACT

Disclosed are bulk lyophilization containers including aseptic closure portions or heat flux equalization portions that promote improved bulk lyophilization. Also disclosed are methods of using the bulk lyophilization containers and improved lyophilization stoppers.

24 Claims, 20 Drawing Sheets

FIG. 4A
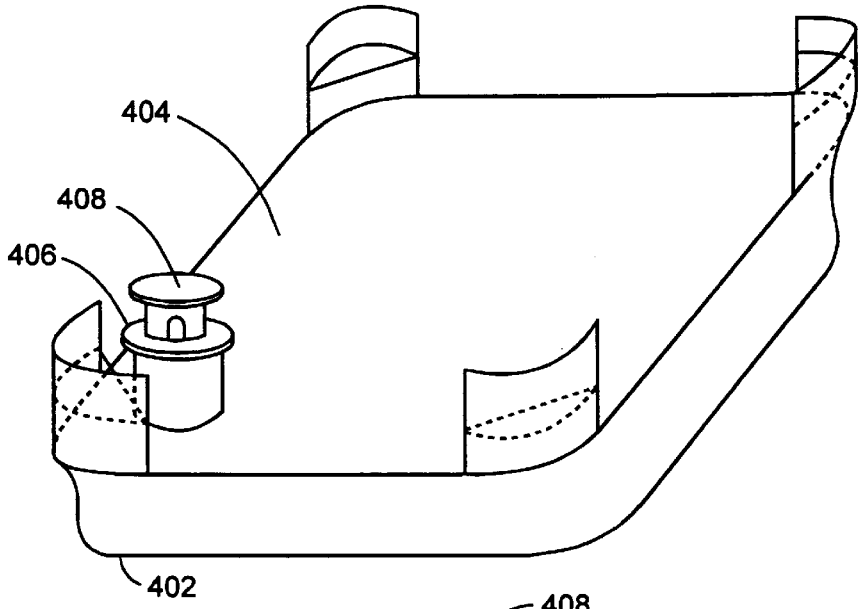
FIG. 4B
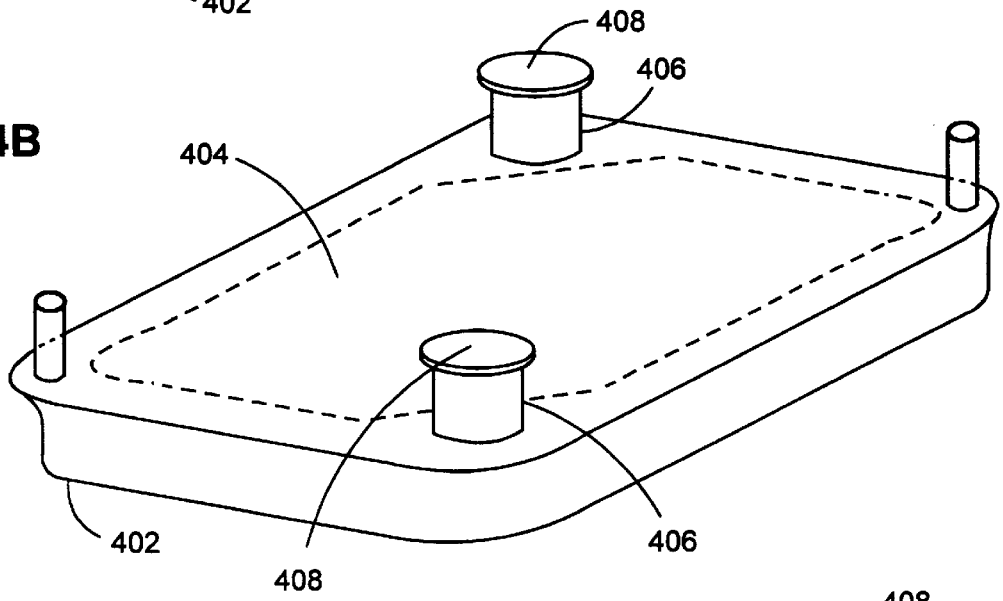
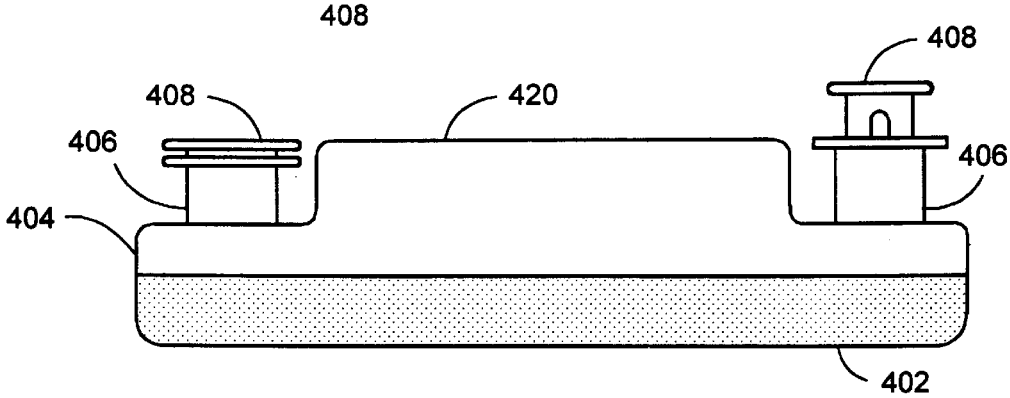
FIG. 4C

A - A

LYOPHILIZATION APPARATUS AND METHODS

BACKGROUND OF THE INVENTION

1. Field of the Invention

The invention relates to lyophilization, more particularly to improved methods and apparatus for bulk lyophilization.

2. Description of Related Art

Freeze drying, or lyophilization, is a dehydration technique. It takes place while a product is in a frozen state (ice sublimation under a vacuum) and under a vacuum (drying by gentle heating). These conditions stabilize the product, and minimize oxidation and other degradative processes. The conditions of freeze drying permit running the process at low temperatures, therefore, thermally labile products can be preserved. Freeze drying has become an accepted method of processing heat sensitive products that require long term storage at temperatures above freezing.

Steps in freeze drying include pretreatment, freezing, primary drying and secondary drying. Pretreatment includes any method of treating the product prior to freezing. This may include concentrating the product, formulation revision (i.e., addition of components to increase stability and/or improve processing), decreasing a high vapor pressure solvent or increasing the surface area. Methods of pretreatment include: freeze concentration, solution phase concentration, and formulating specifically to preserve product appearance or to provide lyoprotection for reactive products. The term "lyoprotection" refers to stabilization during all of the freeze drying process (i.e., during both freezing and drying).

The second step is to freeze the product. Freezing the product decreases chemical activity by decreasing molecular movement. Freezing is essentially the dehydration step in freeze drying; once the solvent matrix is in the solid (frozen) state, the solute matrix is "dry," (although it may contain some bound water. A rule of thumb for freezing product is that the product container should preferably not be filled with product to more than half of its total volumetric rating. In practice this may also mean filling the product only to certain depth to facilitate freezing, ice sublimation and final water/solvent removal. This helps insure, in most cases, that the surface to depth ratio is such that freeze drying is not impeded by the product depth.

How a product is frozen is determined in part by the type of product container and freeze dryer to be used. If larger flasks are to be used in conjunction with a manifold freeze dryer the product should be shell frozen. The rotation of a flask, around its vertical or tilted axis, either by hand in a dry ice alcohol bath or by using a bath specifically designed for shell freezing, increases the surface area substantially. This shell freezing technique promotes conditions of more compact development of large drying surfaces when freeze drying larger volumes of product in flasks although the formation of ice crystals may depend on false movement.

If large numbers of smaller product containers are to be processed in a tray dryer, static or plug freezing is performed. The serum bottle, vial or ampule is filled to the appropriate level and the product is frozen while the container is in an upright position. This type of freezing is typically employed with product volumes of 25 ml or less.

When a product is to be processed in a tray/shelf dryer, the product containers are loaded into trays for introduction to the freeze dryer. If the product has been prefrozen the shelves of the tray dryer should be pre-cooled to a temperature slightly below the freezing point of the product. In most cases the room temperature product is introduced to room temperature shelves of the tray/shelf dryer. The tray/shelf dryer refrigerator is then activated to freeze the product. The refrigerator may be used to reach the temperature below the eutectic and glassy state temperatures of product and solutes. Then the primary drying may begin, e.g. the sublimation of ice crystals at low pressure and at temperatures low enough to reduce cake softening and collapse. After removal of the ice crystals by sublimation, the remaining matrix may still contain bound water/solvent that may be removed by slow heating under low pressure conditions. The drying temperature may be gradually increased as the water content in the dried matrix decreases. Any local overheating of the product matrix may cause localized product deterioration and/or collapse.

When the product reaches a temperature above 0° C., secondary drying may have already begun. A product in secondary drying often appears dry. However, some "bound" solvent may still remain in the apparently dry product. During secondary drying, a vacuum pump creates a low pressure condition that promotes removal of bound solvents. The amount of residual water or solvent in the lyophilized product is dependent on the length of time the product remains in secondary drying. Final level of water/solvent content is important for product storage, e.g. if the water content is too high the product matrix may experience melting and collapse if the storage temperature is increased. Uniformity of water/solvent removal across large areas and volumes of product is thus very important to protect product from local deterioration during lyophilized product storage at ambient temperatures.

Once the product is at the end of its lyophilization cycle it should be removed from the freeze dryer. In a stoppering shelf/tray dryer, an inert gas may be bled into the chamber forming an inert "gas cap" over the product prior to stoppering. Many products are simply stoppered while under vacuum. The stoppers used most commonly on serum vials/bottles have a vacuum integrity of approximately 5 years when used in conjunction with tear off seals. Once the product is stoppered, the system is returned to atmospheric pressure and the shelves are unloaded.

Bulk trays may be used in lyophilization processes to preserve products or intermediates for further processing. Bulk trays typically contain many times the volume of product or intermediate contained in a conventional lyophilization stopped vial/bottle. Therefore, if it is necessary to store a product or intermediate for further processing through lyophilization, bulk lyophilization reduces the amount of handling of the product or intermediate as compared to lyophilizing in vials. This is a significant advantage in terms of cost and contamination.

However, bulk lyophilization has some drawbacks. If bulk trays are used in the freeze drying product, the system is brought to atmospheric pressure and the trays are then unloaded. Product processed in this way likely will absorb the water vapor with which it comes in contact. Consequently this product should be processed or stored as quickly as possible. Due to exposure of the product surface to the environment there is a possibility of contamination. Therefore, bulk lyophilization (filling the open trays, loading the open trays into lyophilizer and unloading the open trays from lyophilizer, etc.) requires a clean room environment, with attendant high cost of the room, cost of its maintenance, complex operational procedures, etc. Subsequent handling of powder (e.g., emptying the open trays with elevated edges) or powder reconstitution with liquid also requires a clean room environment. Further, flat, open, shallow trays being filled and handled create the possibility of spills.

Finally, bulk lyophilization trays preferably are flat enough to match the contours of the shelf and promote good heat transfer between the shelf and the tray. This condition may not be easy to maintain during multiple uses of trays—such trays may be too flimsy and may become warped. Warpage may lead to non-uniform lyophilization—a clear disadvantage.

There is therefore a need for improved methods and apparatus for lyophilization to address the problems noted above.

SUMMARY OF THE INVENTION

In an aspect, the invention relates to a bulk lyophilization container comprising a body portion; and an aseptic closure portion, wherein the body portion is coupled to the aseptic closure portion.

In another aspect, the invention relates to a bulk lyophilization container comprising a heat flux equalizer portion located so as to equalize a heat flux through the bulk lyophilization container.

In still another aspect, the invention relates to a method of lyophilization of a product comprising increasing uniformity of heat flux to or from the product during any freezing, primary or secondary drying operations that occur during the lyophilization.

In an aspect, the invention relates to a lyophilization stopper comprising three or more straight vent notches. The invention also relates to a lyophilization stopper comprising sealing ridges located on an outer surface of the lyophilization stopper, a lyophilization stopper comprising stopper window vents that penetrate the stopper, and a lyophilization stopper comprising shallow vents that do not penetrate the stopper.

BRIEF DESCRIPTION OF THE DRAWINGS

FIG. 2F shows an isometric elevation of a bulk lyophilization container according to the invention.

FIGS. 4A–B show isometric elevations of a bulk lyophilization container according to the invention.

FIG. 4C shows a cross-section of a bulk lyophilization container according to the invention.

DETAILED DESCRIPTION OF THE INVENTION

Figure 1A:
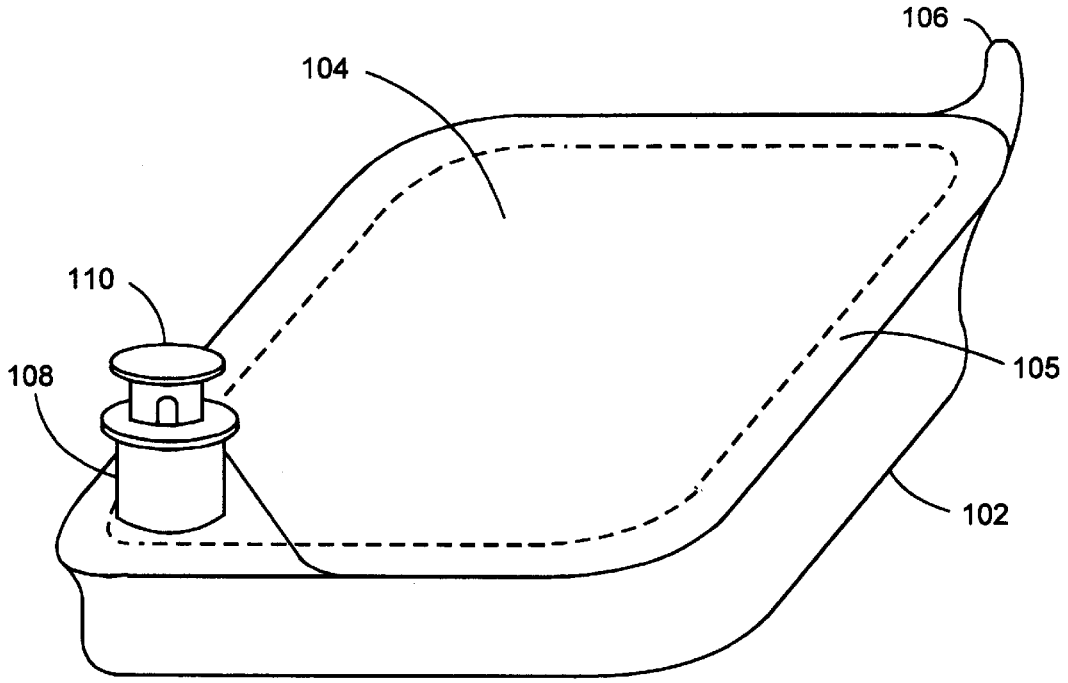
FIG. 1A shows an isometric elevation of a bulk lyophilization container according to the invention.
Figure 1B:
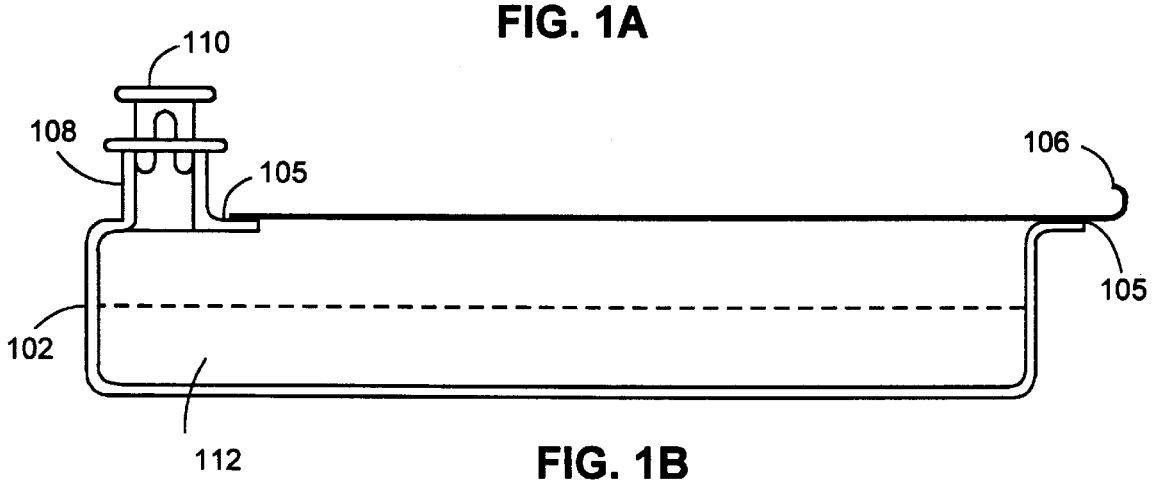
FIGS. 1B–C show cross-sections of bulk lyophilization containers according to the invention.

FIG. 1A shows an isometric view of an embodiment of a bulk lyophilization container according to the invention. FIG. 1B shows a cross-sectional view of the embodiment. In FIG. 1A, body portion 102, aseptic closure portion 104, seal 105, opening handle 106, neck 108, and stopper 110 are indicated. Body portion 102 is covered by aseptic closure portion 104 and sealed along seal 105, forming an aseptic container for the product undergoing lyophilization. The use of aseptic closure portion 104 may reduce risk of contamination or spillage during tray filling with liquid and bulk lyophilization and subsequent tray handling. Additionally, use of aseptic closure portion 104 enables the inventive bulk lyophilization container to be made stiffer, with less consequent warpage during use. This may lead to improved heat transfer and thus improved lyophilization results. Therefore, inclusion of aseptic closure portion 104 in the inventive bulk lyophilization container represents a significant advance over previous attempts to perform bulk lyophilization. Opening handle 106, coupled to aseptic closure portion 104, enables opening of the container by a user, for example after lyophilization; thus facilitating recovery of the lyophilized product.

According to the invention, the product to be lyophilized is contained in body portion 102. Neck 108 and stopper 110 serve to permit filling of the bulk lyophilization container and to permit vapor to escape at an appropriate step of the lyophilization process. After sufficient solvent has been removed from product 112, stopper 110 may be pushed down into neck 108, completely sealing the container. FIG. 1B further illustrates this arrangement. The product powder may be reconstituted with liquid through the neck 108 without opening the aseptic closure portion 104.

Figure 1C:
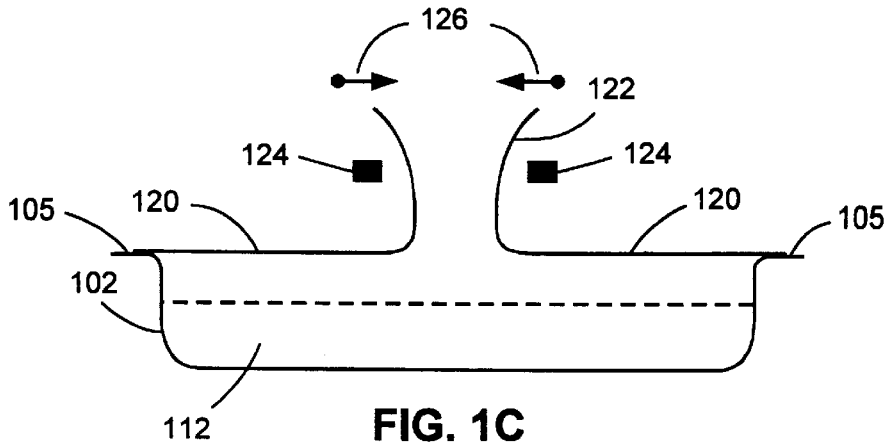

FIG. 1C is a cross-section of a bulk lyophilization container according to the invention, showing an alternative sealing arrangement. Shown are body portion 102, aseptic closure portion 120, seal 105, product 112, and sealable neck 122. Aseptic closure portion 120 and seal 105 serve to form an aseptic barrier across the opening of body portion 102. Sealable neck 122 permits product 112 to be filled aseptically into the bulk lyophilization container, and allows vapor to escape during lyophilization. After lyophilization, sealable neck 122 may be sealed by sealing equipment 124, along the direction indicated by arrows 126, to form an aseptic enclosure.

Figure 2A:
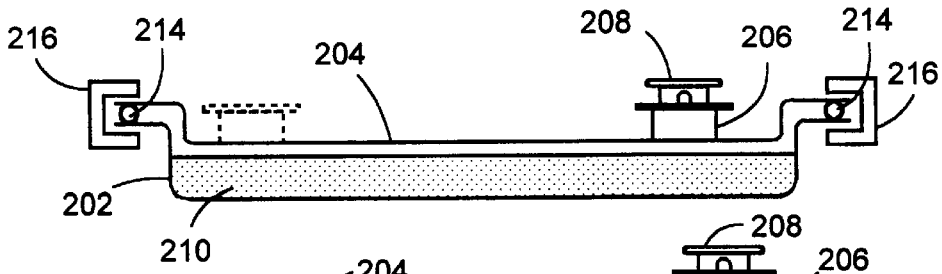
FIGS. 2A–F show cross-sections of bulk lyophilization containers according to the invention.
Figure 2B:
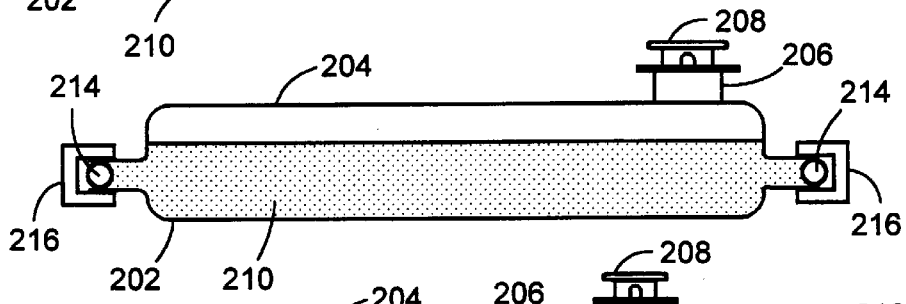
Figure 2C:
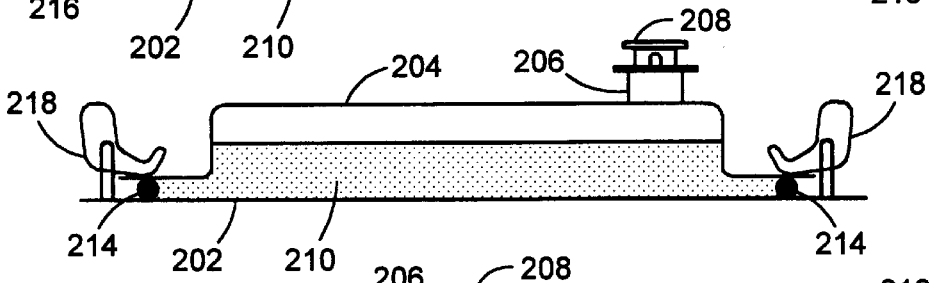
Figure 2D:
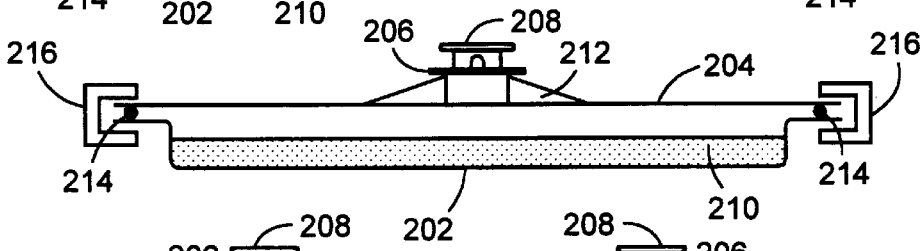
Figure 2E:
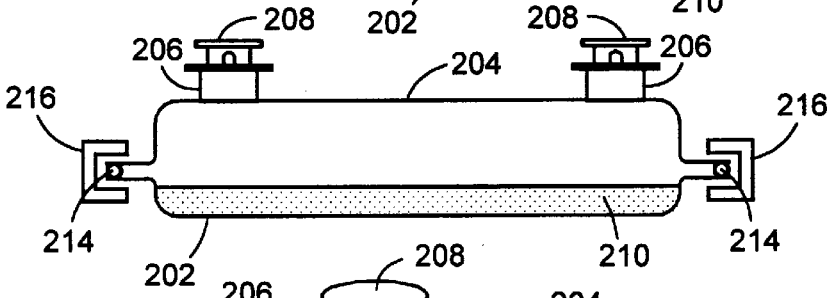
Figure 2F:
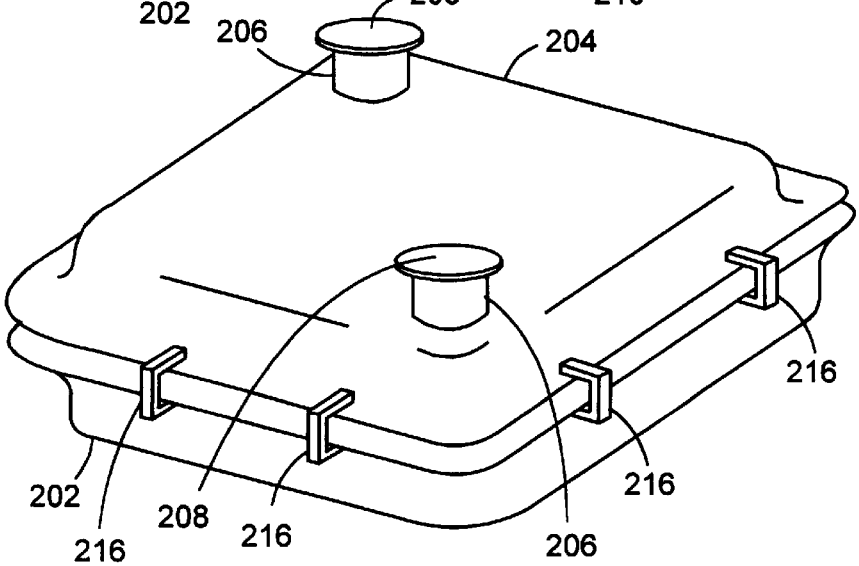

FIGS. 2A–F show several exemplary embodiments of the inventive present invention, emphasizing seal configurations. In FIGS. 2A–2D, the body portion 202, aseptic closure portion 204, neck 206, stopper 208, product 210, stiffener 212, seal 214, C-clips 216, and mechanical clamps 218 are indicated. Relative to the interior of the product receptacle, FIG. 2A shows a concave body portion 202 and convex aseptic closure portion 204 combination. FIG. 2B shows a concave body portion 202 and concave aseptic closure portion 204 configuration. FIG. 2C shows a flat body portion and concave aseptic closure portion 204 configuration, with spring clamps 218. FIG. 2D shows a concave body portion 202 and flat aseptic closure portion 204 configuration, with stiffeners 212 to support neck 206. FIG. 2E shows a concave body portion 202 and concave aseptic closure portion 204 configuration, with two necks 206. FIG. 2F is an isometric view of the bulk lyophilization container embodiment shown in FIG. 2E.

Multiple necks may permit faster removal of the water/solvent vapor (less flow resistance) during intensive lyophilization processes. This may be a consideration in the practice of the present invention in that the area through which vapor may flow during lyophilization may be reduced by the addition of the aseptic closure portion. Accordingly, multiple necks (or modified lyophilization stoppers, as discussed further below) may be utilized to increase the rate of bulk lyophilization when bulk lyophilization is being practiced according to the present invention. Multiple necks may also be built into trays with large surface areas.

Figure 3A:
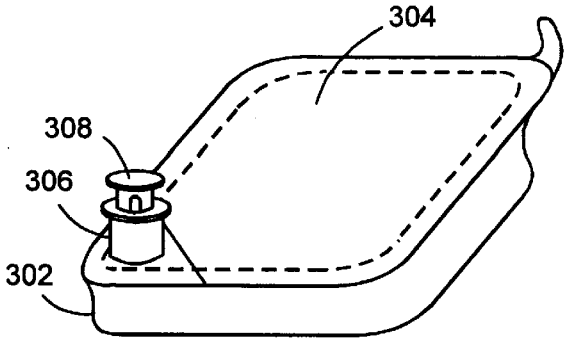
FIGS. 3A–H show isometric and top elevations of bulk lyophilization containers according to the invention.
Figure 3B:
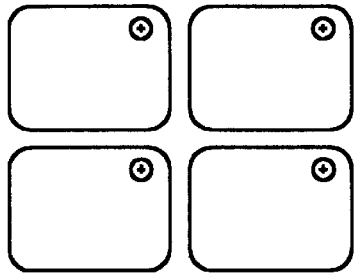
Figure 3C:
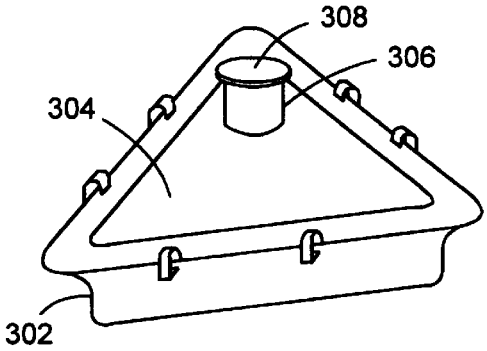
Figure 3D:
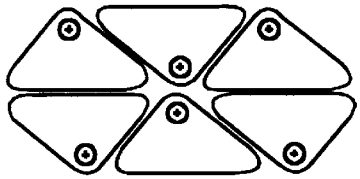
Figure 3E:
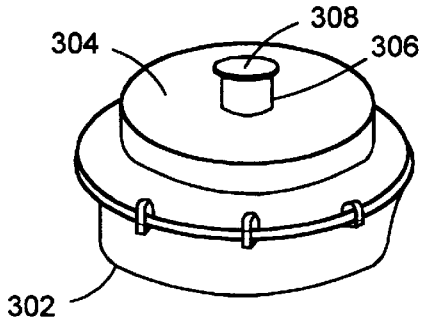
Figure 3F:
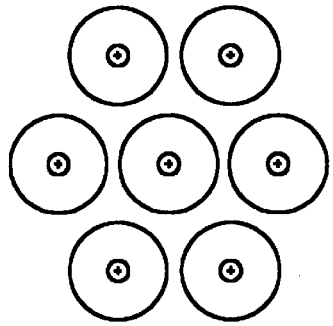
Figure 3G:
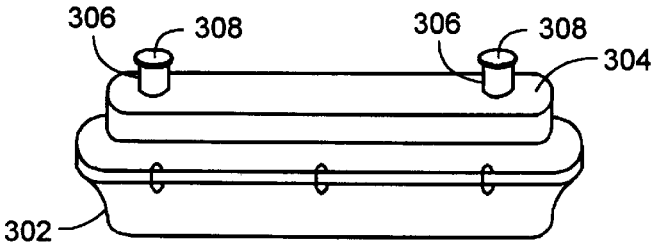
Figure 3H:
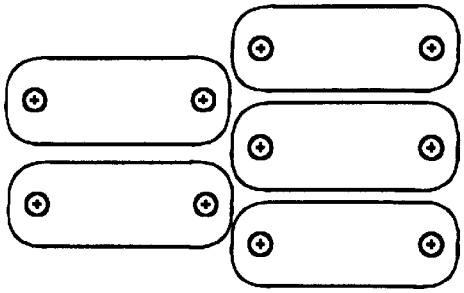

FIGS. 3A–H show several exemplary plan view geometries and array formations according to the present invention. In FIGS. 3A–3D, body portion 302, covering element 304, neck 306, and stopper 308 are indicated. FIG. 3A shows a rectangular (quadrilateral) bulk lyophilization container according to the invention. FIG. 3B shows the rectangular (quadrilateral) bulk lyophilization container of FIG. 3A arranged in an array for compact storage. FIG. 3C shows a triangular bulk lyophilization container according to the invention. FIG. 3D shows the triangular bulk lyophilization container of FIG. 3C arranged in an array for compact storage. FIG. 3E shows a circular bulk lyophilization container according to the invention. FIG. 3F shows the circular bulk lyophilization container of FIG. 3E arranged in an array for compact storage. FIG. 3G shows an elliptical bulk lyophilization container according to the invention. FIG. 3H shows the elliptical bulk lyophilization container of FIG. 3G arranged in an array for compact storage. Various polygonal and non-polygonal geometries including, but not limited to, pentagonal, hexagonal, etc. beyond those shown will no doubt occur to one of skill in the art, and are within the scope of the invention.

FIGS. 4A–C show exemplary alignment and supporting aids for vertical stacking of the bulk lyophilization containers according to the present invention. FIGS. 4A–C show body portion 402, aseptic closure portion 404, neck 406, stopper 408, edge support/alignment element 410, support/alignment pin 412, and raised center portion 420. In FIGS. 4A–B, edge support/alignment element 410 or support/alignment pin 412 serve to align and support vertically stacked bulk lyophilization containers according to the invention. In FIG. 4C, raised center portion 420 serves to support vertically stacked bulk lyophilization containers according to the invention. Additional alignment or support configurations beyond those shown will no doubt occur to one of skill in the art, and are within the scope of the invention.

Figure 5A:
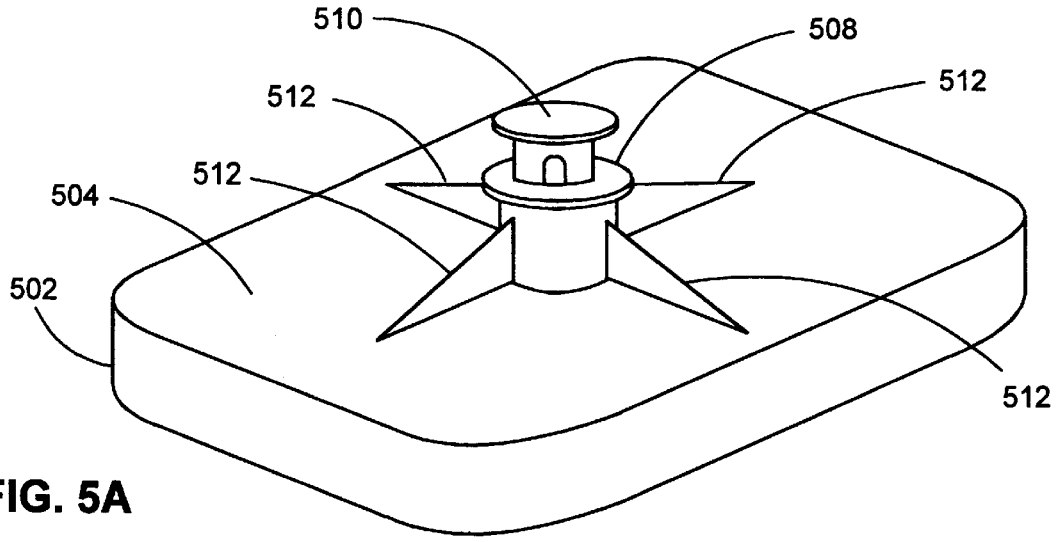
FIGS. 5A, E, and F show isometric elevations of bulk lyophilization containers according to the invention.
Figure 5B:
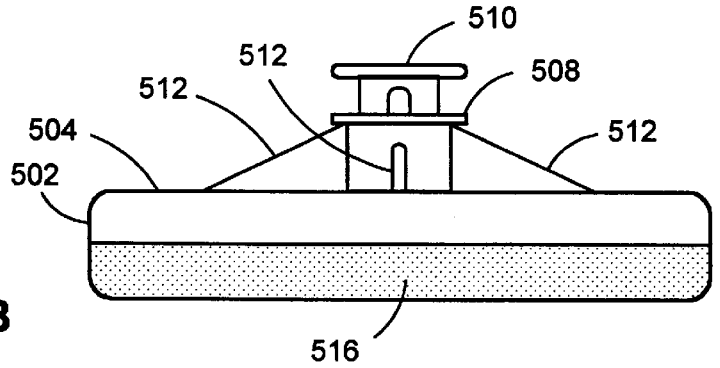
FIGS. 5B–D show cross-sections of bulk lyophilization containers according to the invention.
Figure 5C:
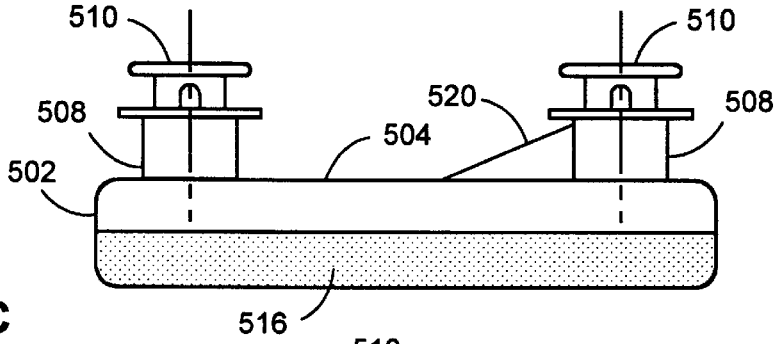
Figure 5D:
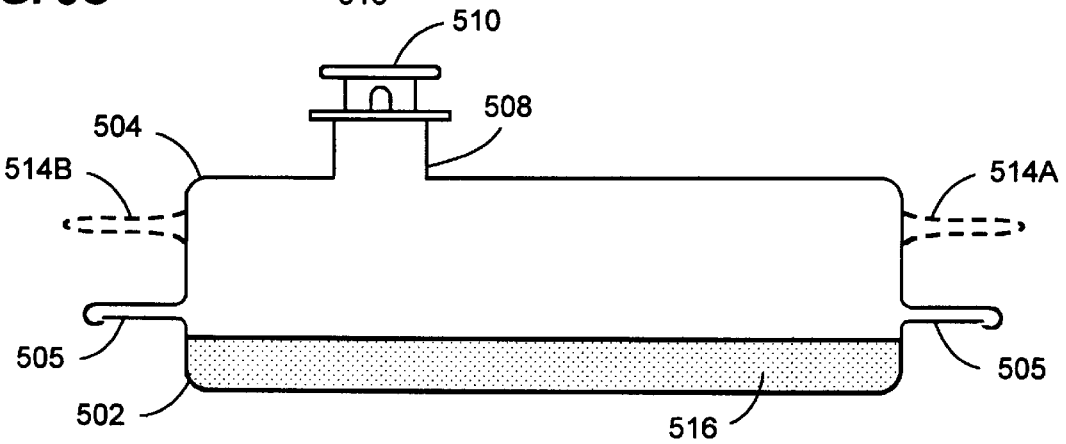

FIGS. 5A–5F show exemplary locations of the neck according to the present invention. In FIGS. 5A–C, body portion 502, aseptic closure portion 504, seal 505, neck 508, stopper 510, reinforcing stiffener 512, and optional liquid ports 514A–B are indicated. FIG. 5A shows an isometric view of an embodiment of the inventive bulk lyophilization container useful for lyophilization followed by reconstitution. Shown are body portion 502 integral with aseptic closure portion 504, neck 508, stopper 510 (located roughly centrally as shown, but potentially offset in certain embodiments with respect to the sides of the bulk lyophilization container, and shown in the open position, and reinforcing stiffeners 512 to reinforce and stiffen neck 508. FIG. 5B shows the bulk lyophilization container of FIG. 5A in a cross-sectional view. Also depicted in FIG. 5B is product 516, shown at a typical level within the embodiment of FIG. 5B. FIG. 5C shows a cross-sectional view of an embodiment of the inventive bulk lyophilization container useful for lyophilization followed by reconstitution. Shown are body portion 502 integral with aseptic closure portion 504, necks 508, stoppers 510, product 516 and reinforcement stiffener 520. Two necks and stoppers are provided so that, for example, one neck may be used for introducing material and the other neck may be used as a vent. Two or more necks also increase the cross-sectional area through which vapor may be passed during lyophilization, thus decreasing lyophilization time. Such multi-neck embodiments may be useful in embodiments of the invention generally as is appropriate. Reinforcement stiffener 520 serves to reinforce neck 508. Only one reinforcement stiffener may be present, or more than one may be present. FIG. 5D shows a cross-section of a bulk lyophilization container according to the invention, suitable for use in lyophilization and reconstitution. Shown are body portion 502, aseptic closure portion 504, seals 505, neck 508, stopper 510, product 516, and optional liquid ports 514A–B. Seals 505 serve to couple body portion 502 and aseptic closure portion 504. Neck 508 and stopper 510 are arranged and function as described above. Optional liquid ports 514A–B are shown in a sealed configuration. Optional liquid ports 514A–B may be used to empty reconstituted liquid from the bulk lyophilization container, for example by clipping the ends of the optional liquid ports to create an opening in the bulk lyophilization container. Alternatively, reconstituted liquid may be removed from the bulk lyophilization container by pouring it out of neck 508 or from liquid port(s) 514A–B.

Figure 5E:
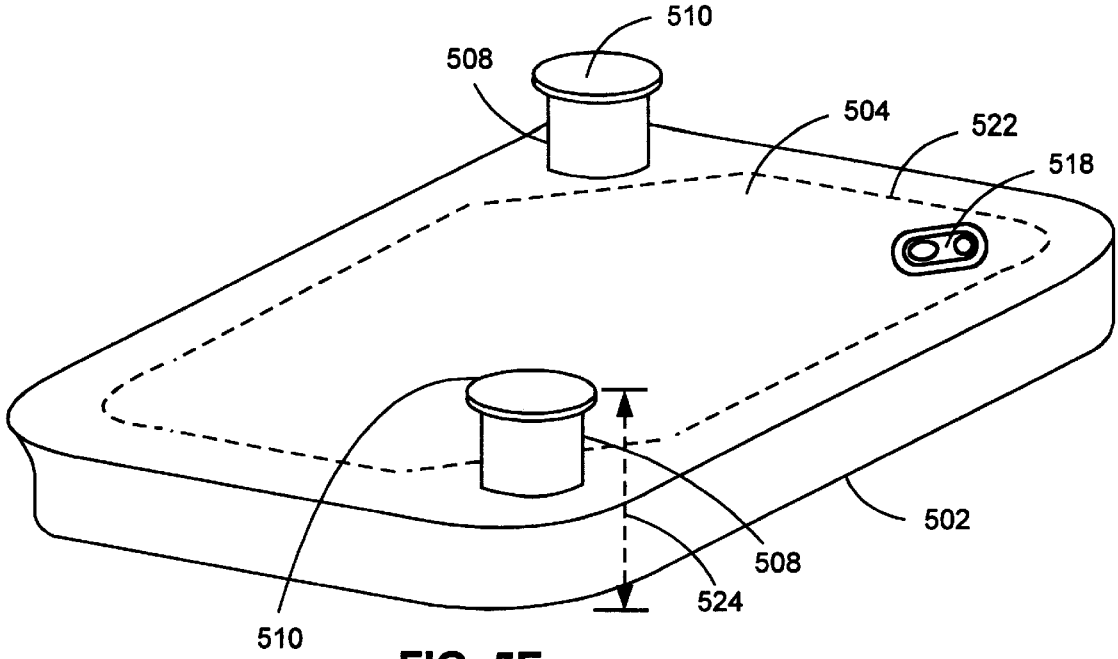
Figure 5F:
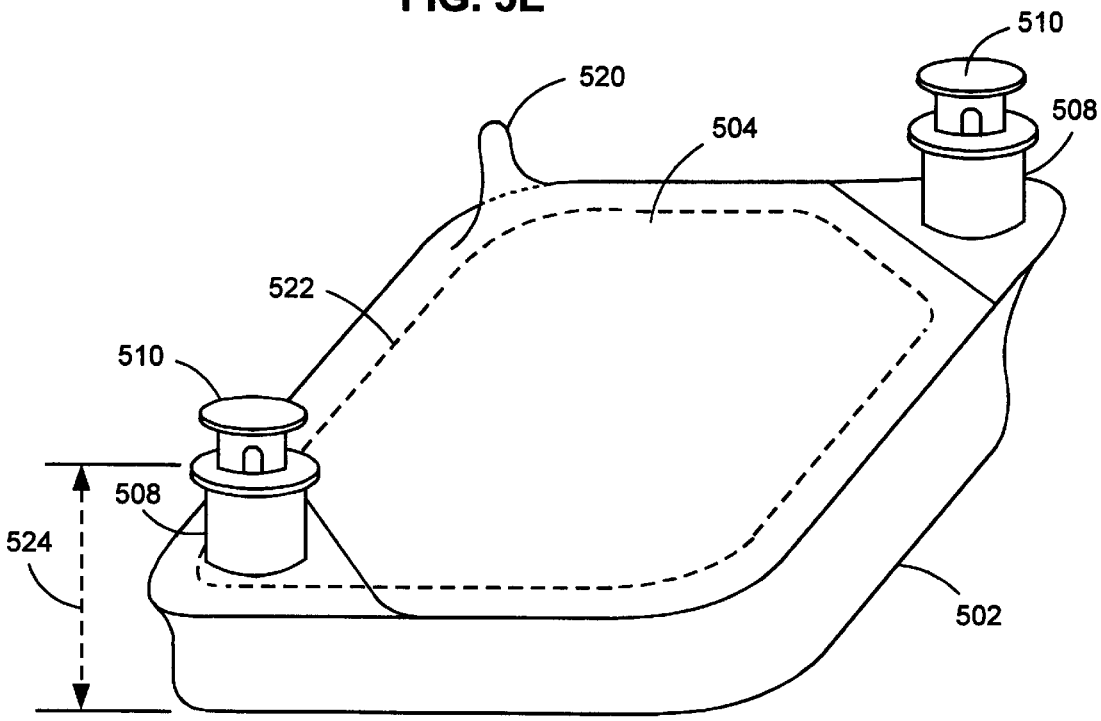

FIGS. 5E–F show multi-neck embodiments if the inventive bulk lyophilization containers according to the invention. Two necks and stoppers are provided so that, for example, one neck may be used for introducing material and the other neck may be used as a vent. Two or more necks also increase the cross-sectional area through which vapor may be passed during lyophilization, thus decreasing lyophilization time. More than two necks are also contemplated as within the scope of the invention. Such multi-neck embodiments may be useful in embodiments of the invention generally as is appropriate. For example, more than the two shown necks may be utilized for large surface containers. FIG. 5E shows body portion 502, aseptic closure portion 504, seals 505, neck 508, stopper 510, opening tab 518, opening handle 520, and scoring 522. The structure and function of these elements are similar to those described above. In particular, opening tab 518 and opening handle 520 may be used to pull open body portion 502 along scoring 522.

Stoppers 510 are shown as being in a closed position in FIG. 5E, and in an open position in FIG. 5F. In the bulk lyophilization container embodiments according to the invention, the bulk lyophilization containers are preferentially of a height 524 (as shown in the exemplary embodiments of FIGS. 5E–F) that is suitable for use in conventional, preferably stoppering shelf-type lyophilizers. More preferably, the height 524 of the inventive bulk lyophilization containers is such that conventional stoppering shelf-type lyophilizers may be used to close stoppers 510 in necks 508, thus sealing closed the inventive bulk lyophilization containers.

Figure 6A:
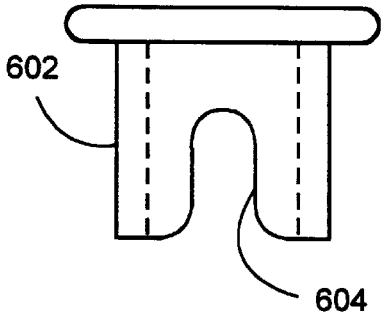
FIG. 6A (PRIOR ART)
FIGS. 6A–F show isometric and cross-sections of lyophilization stoppers according to the invention.
Figure 6B:
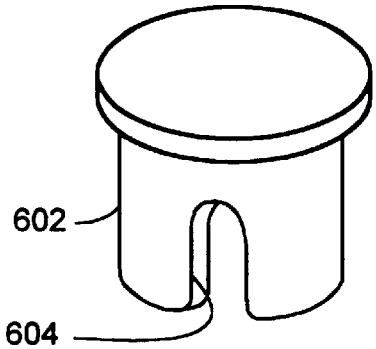
FIG. 6B (PRIOR ART)

FIGS. 6A–B show different views of a prior art lyophilization stopper. In FIG. 6A, which is a side view of a prior art lyophilization stopper, stopper body 602 and straight vent notch 604 are indicated. As is shown, the prior art lyophilization stopper possesses two straight vent notches 604. FIG. 6B shows the prior art lyophilization stopper shown in FIG. 6A in an isometric view. Straight vent notches 604 permit the escape of vapor from a lyophilization container when the stopper is not pushed into and sealed against a neck of the lyophilization container.

Figure 6C:
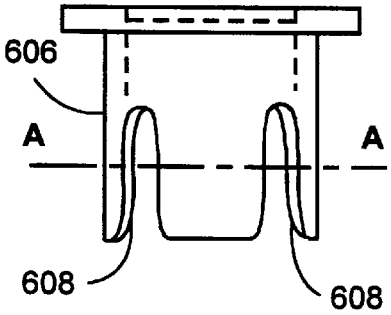
Figure 6D:
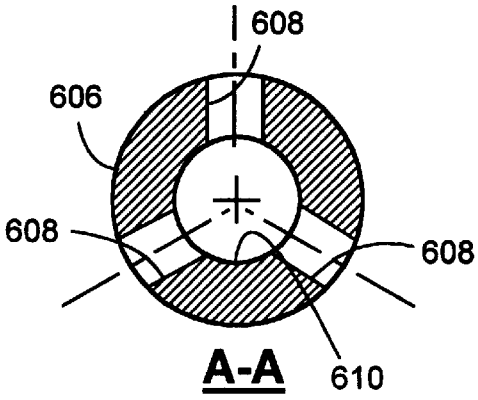

FIG. 6C shows a lyophilization stopper with three straight vent notches, including stopper body 606, and straight vent notches 608. The addition of a third straight vent notch provides a more open cross-sectional area through which vapors may pass during lyophilization. This additional cross-sectional area therefore serves to increase the flow rate of vapors out of the lyophilization container, and decrease the lyophilization time. While the innovation of increasing cross-sectional area for vapor passage is applicable to lyophilization stoppers generally, in a preferable embodiment such lyophilization stoppers are used with the inventive bulk lyophilization containers. FIG. 6D shows a cross-section taken as indicated by line A—A through the lyophilization stopper of FIG. 6C. Shown are stopper body 606, three straight vent notches 608, and hollow center portion 610, and arrangements of each relative to one another.

Figure 6E:
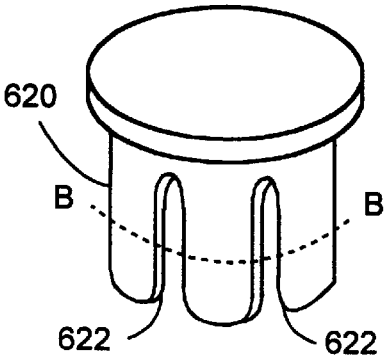
Figure 6F:
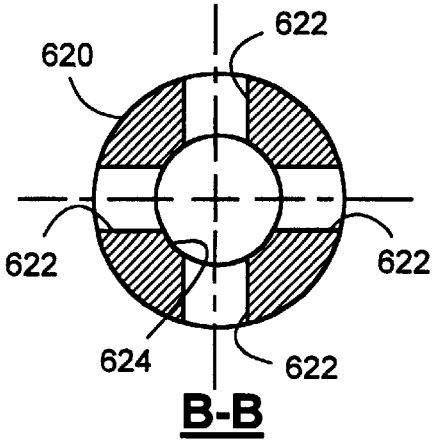

FIG. 6E shows a lyophilization stopper with four straight vent notches, including stopper body 620, and straight vent notches 622. The addition of a fourth straight vent notch may increase the open cross-sectional area of the lyophilization stopper as compared to the lyophilization stoppers of FIGS. 6A & 6C. This additional cross-sectional area serves to further increase the flow rate of vapors out of the lyophilization container, and further decrease the lyophilization time. FIG. 6F shows a cross-section taken as indicated by line B—B through the lyophilization stopper of FIG. 6E. Shown are stopper body 620, four straight vent notches 622, and hollow center portion 624, and arrangements of each relative to one another.

FIG. 7A–L show lyophilization stopper and vent embodiments according to the present invention. In FIG. 7A–7G, straight vent notch 712, sealing ridges 720, first stopper leg thickness 730, second stopper leg thickness 740, stopper leg end radius 750, stopper leg 760, stopper window vent 770, stopper window vent reinforcing zones 772, neck 774, pierced neck 778, neck window vents 780, and unvented stopper 782 are illustrated.

Figure 7A:
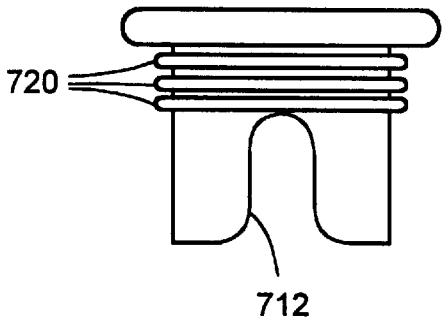
FIGS. 7A–L show side and cross-section elevations of lyophilization stoppers according to the invention.

FIG. 7A shows a lyophilization stopper according to the present invention with stopper body 710 comprising sealing ridges 720 located on an outer surface along with straight vent notch 712. Sealing ridges 720 provide a potentially better seal between the stopper and a neck of a lyophilization container when the stopper is pushed into the neck. Such a design is particularly useful for non-elastomeric lyophilization stopper materials. The sealing ridges may possess various cross sections, e.g. semi-circular, triangular, trapezoidal, square/rectangular, a split lip edge, etc. The individual width of these ridges may vary, e.g. they may have various cross section area and various elastic deformation to ensure collaborative performance among all ridges. The ridges may be separated or touch each other in the free or compressed state. The number of these ridges may vary depending on the stopper material, stopper diameter, length of storage, etc. The inventive lyophilization stoppers comprising sealing ridges may or may not additionally comprise straight vent notches.

Figure 7B:
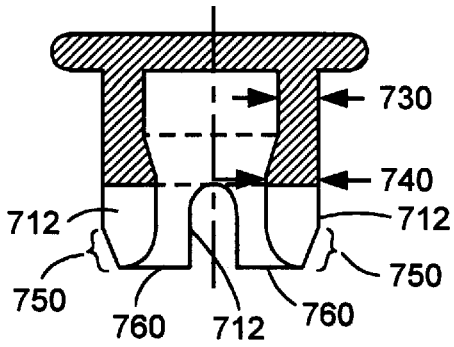

FIG. 7B shows another lyophilization stopper embodiment according to the present invention. Stopper legs 760 define straight vent notches 712. Further, stopper legs 760 are stiffer than legs of the prior art stoppers as shown in FIGS. 6A–6B. The increased stiffness of stopper legs 760 may be accomplished by having a second stopper leg thickness 740 that is greater than a first stopper leg thickness 730, as shown. Stopper leg end radii, such as stopper leg end radius 750, may be utilized generally, as appropriate, in lyophilization stoppers according the invention to reduce folding of the stopper legs upon insertion into a neck of a lyophilization container.

Figure 7C:
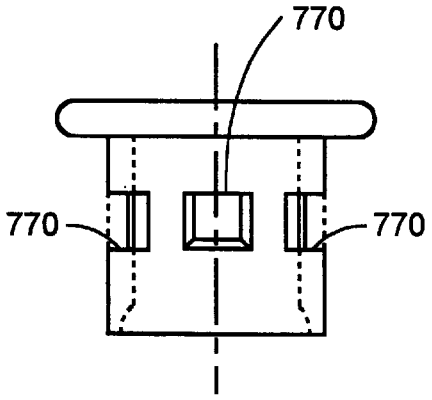

FIG. 7C shows a stopper according to the present invention including stopper window vents 770. These vents may act as passages for the escape of vapor from bulk lyophilization containers and are arrayed about the circumference of the lyophilization stopper. The shape of the stopper window vents 770 may be as shown but is not limited to square/rectangle shape. The circular or oval stopper window vents may also be used. These vents may not only facilitate vapor passage during lyophilization, but also optimize the stopper behavior (deformation under stress and subsequent sealing) during the stoppering step. Various shapes and local reinforcing or weakening zones can further optimize stopper performance during drying, stoppering and storage (sealing).

Figure 7D:
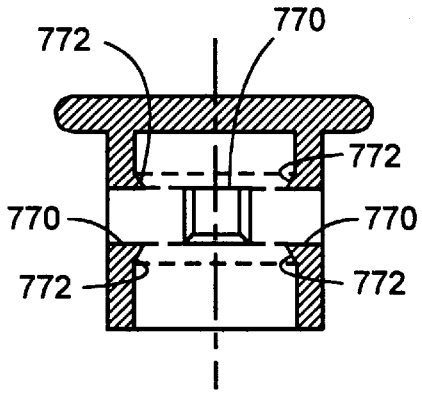

FIG. 7D shows another lyophilization stopper according to the invention. Shown are stopper window vents 770, with window vent reinforcing zones 772 designed to reinforce the area around stopper window vents 770. The window vent reinforcing zones 772 may be used to reduce distortions of stopper window vents 770 when the lyophilization stopper is under a load, such as when the stopper is being pushed into a neck of a lyophilization container.

Figure 7E:
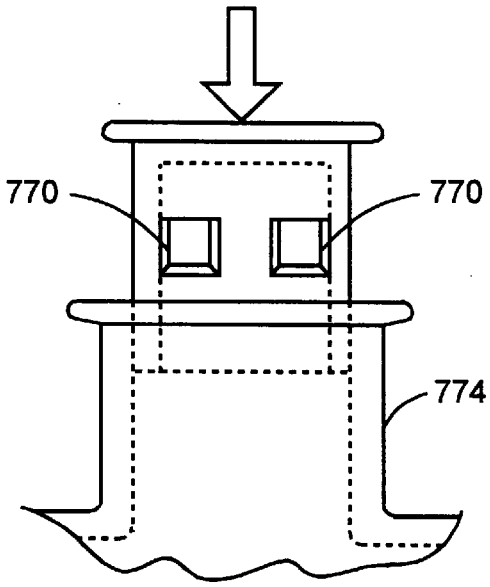
Figure 7F:
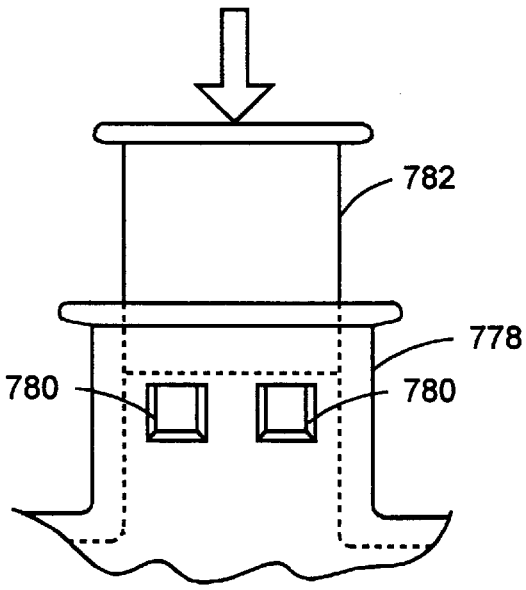

FIG. 7E shows an embodiment of the invention wherein a lyophilization stopper possessing stopper window vents is inserted into neck 774. During lyophilization, vapor may pass through neck 774 and out of the stopper window vents 770. At an appropriate time in the lyophilization process, the iyophilization stopper may be pushed into neck 774 forming a seal. A neck window vent embodiment is also within the scope of the invention. FIG. 7F shows pierced neck 778 comprising neck window vents 780, with unvented stopper 782. In this embodiment, vapor can flow through pierced neck 778 and out of neck window vents 780. The neck window vents are sealed when unvented stopper 782 is pushed into pierced neck 778 far enough so as to seal off neck window vents 780. The pierced neck may also facilitate the container filling with liquid windows in the neck permit liquid-displaced air/gas removal from the container.

Figure 7G:
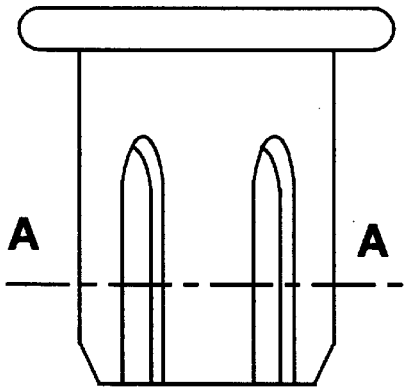
Figure 7H:
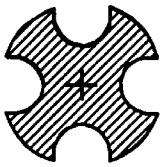
Figure 7I:
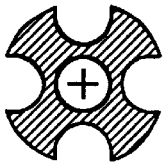
Figure 7J:
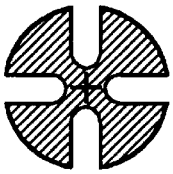
Figure 7K:
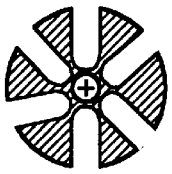
Figure 7L:
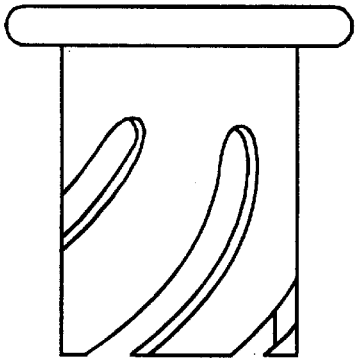

FIG. 7G shows a lyophilization stopper according to the invention. Cross-sections taken through line A—A result in the exemplary geometries shown in FIGS. 7H–K. FIGS. 7H–I show cross-sectional of lyophilization stoppers comprising shallow vents that do not pass completely though the lyophilization stopper. During lyophilization, vapor passes through a channel formed by the shallow vents and an interior surface of a neck within which the lyophilization stopper is present. The cross-section shown in FIG. 7I differs from that shown in FIG. 7H in that the cross-section shown in FIG. 7I possesses a hollow central area, whereas the cross-section shown in FIG. 7H possesses a solid central area. FIGS. 7J–K also show cross-sections of lyophilization stoppers comprising shallow vents that do not pass completely though the lyophilization stopper. The shallow vents shown in FIGS. 7J–K differ from the vents shown in FIGS. 7H–I in shape, and the cross-sectional area of the vents may be different or the same. Shallow vents as shown in these embodiments offer an equivalent structure to the vents shown in the embodiments of FIGS. 6C–F and 7A–F. FIG. 7L shows spiral vents to facilitate stopper insertion during stoppering. Other arrangements will no doubt occur to one of skill in the art and are expressly within the scope of the invention.

FIGS. 8A–8E show exemplary edge sealing embodiments of bulk lyophilization containers according to the present invention. In FIGS. 8A–D, compressing member 810, aseptic covering portion 812, body portion 814, product 816, lyophilization stopper 818, edge sealing element 820, neck 822, rotating catch 824, flat gasket 830, clamp 832, first sealing surface 840, second sealing surface 842, third sealing surface 844, circular gasket 846, fourth sealing surface 855, and cover alignment aids 860 are indicated.

Figure 8A:
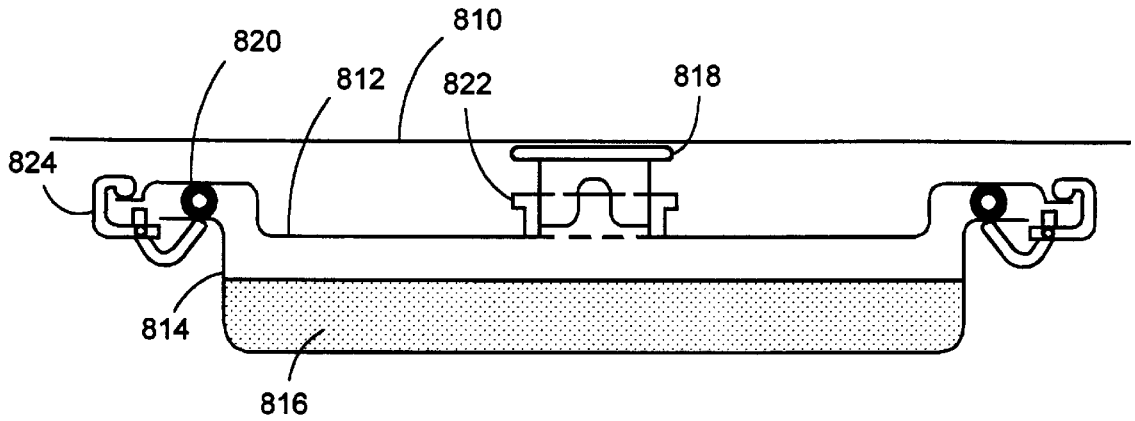
FIGS. 8A–E show cross-section elevations of lyophilization stoppers according to the invention.
Figure 8B:
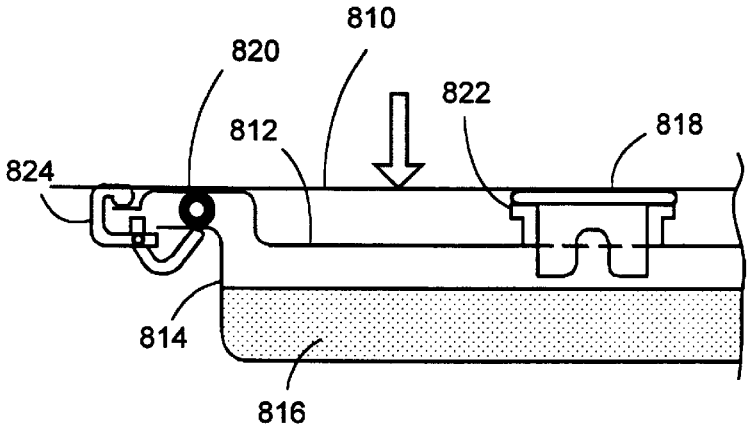

In FIG. 8A, compressing member 810 is shown bearing upon lyophilization stopper 818 to seal it against neck 822. As well, compressing member 810 bears upon aseptic covering portion 812 and compresses edge sealing element 820 to form a seal along the edge of body portion 814. Rotating catch 824 serves to hold aseptic covering portion 812 against body portion 814, thus keeping edge sealing element 820 under compression and maintaining the seal. Contamination of product 816 is thus reduced. FIG. 8B illustrates the compression of edge sealing element 820 by the contacting surfaces of aseptic covering portion 812 and body portion 814.

Figure 8C:
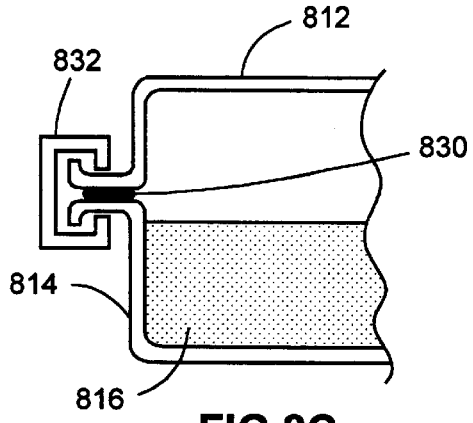
Figure 8D:
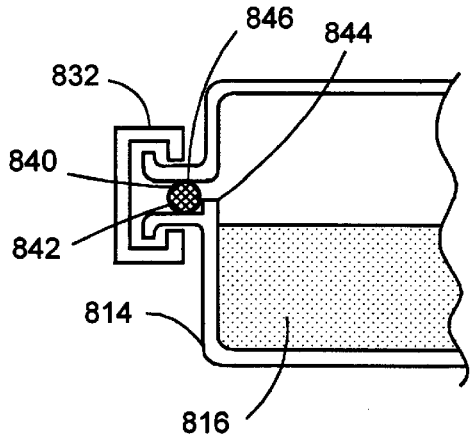
Figure 8E:
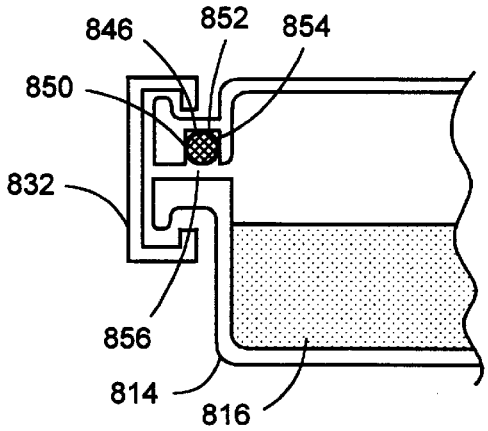
Figure 8F:
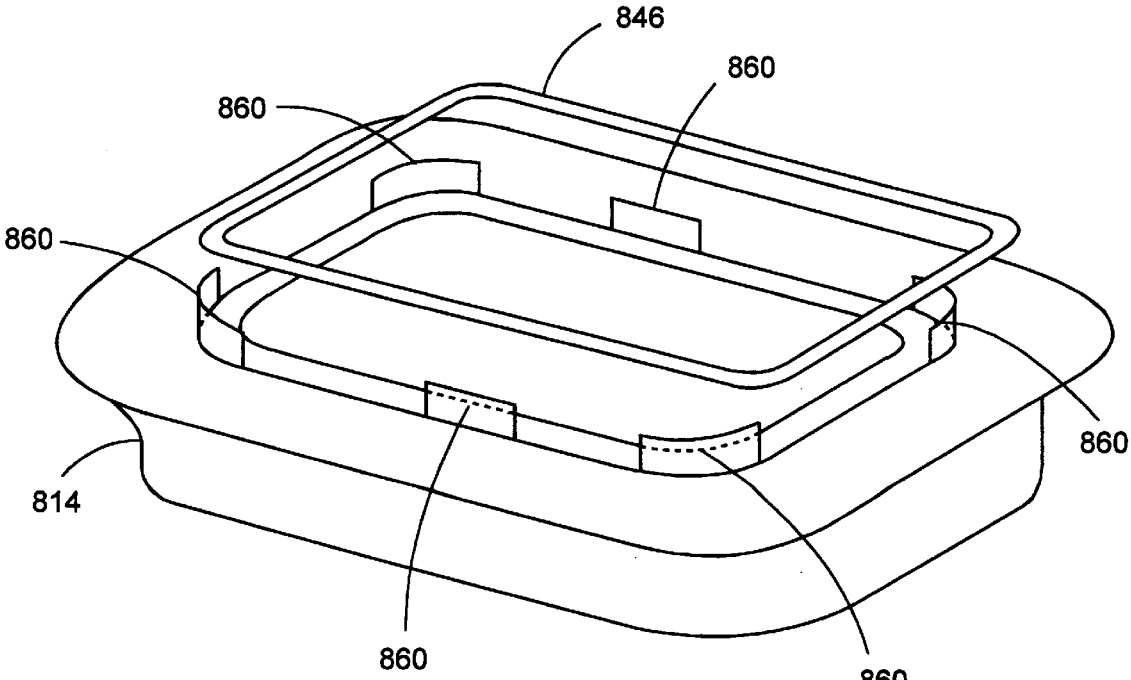
FIG. 8F shows an isometric elevation of a bulk lyophilization container according to the invention.

FIGS. 8C–E show alternate embodiments of edge seals for bulk lyophilization containers according to the present invention. In FIG. 8C, the edge seal is formed by the compression of flat gasket 830 by aseptic covering portion 812 and body portion 814. The seal is maintained by the action of clamp 832. FIG. 8D is an edge sealing embodiment of an inventive bulk lyophilization container with more than two sealing surfaces. FIG. 8E shows first and second sealing surfaces 840 and 842, and a third sealing surface 844. Under compression, circular gasket 846 forms an additional seal with third sealing surface 844. FIG. 8D shows another embodiment of edge seals according to the present invention. In this embodiment, circular gasket 846 is contained in a groove. Upon compression, circular gasket 846 will form seals against four surfaces 850, 852, 854 and 856. FIG. 8F illustrates cover alignment aids 860. Alignment aids 860 assist in positioning of the circular gasket 846 over body portion 814 in order to properly form edge seals.

Figure 9A:
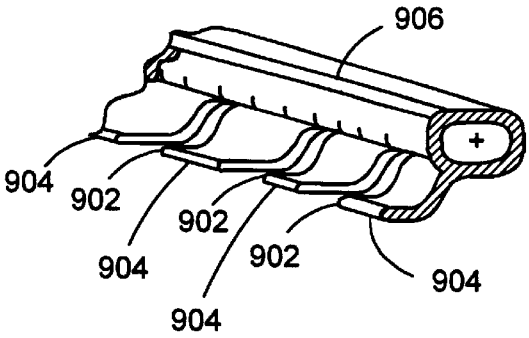
FIGS. 9A–M show cross-sections of seals according to the invention that are useful in aseptic sealing, particularly in aseptic sealing of bulk lyophilization containers according to the invention.

FIGS. 9A–E show exemplary embodiments of edge seal-vents for bulk lyophilization containers according to the present invention. FIG. 9A shows edge vents 902, tabs 904, and edge sealing element 906. Edge vents 902 are coupled to edge sealing element 906 and provide a path for vapor to travel through during lyophilization. Tabs 904 are also coupled to edge sealing element 906 and define edge vents 902. Tabs 904 may be coupled to a body portion either slidably or nonslidably. Under compression, edge vents 902 are squeezed closed, and edge sealing element 906 forms a seal.

Figure 9B:
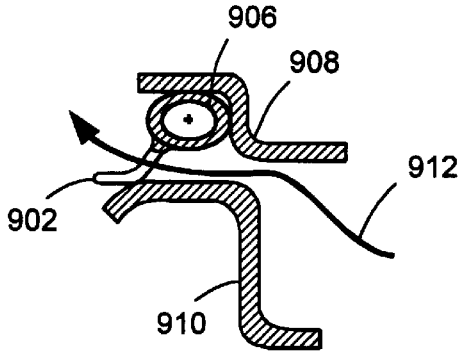
Figure 9C:
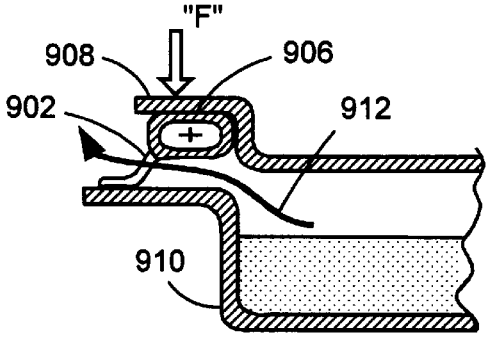
Figure 9D:
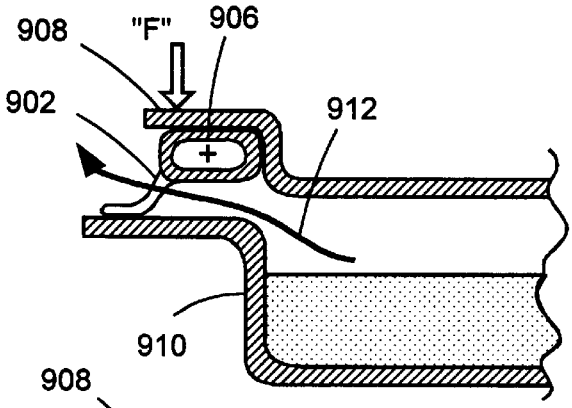
Figure 9E:
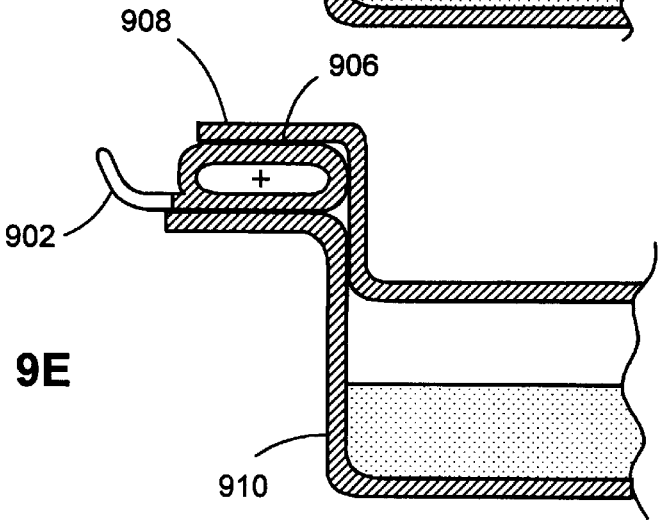

This is better illustrated in FIG. 9B. Shown are edge vents 902, edge sealing element 906, aseptic closure portion 908, body portion 910, and vapor path 912. As shown in FIG. 9B, when uncompressed, edge vents 902 allow vapor to escape along vapor path 912. This vapor path may be in addition to a vapor path through a neck or stopper, or it may be the sole vapor path. Upon compression, edge vents 902 are closed and a seal is formed between aseptic closure portion 908 and body portion 910 by edge sealing element 906. This blocks vapor path 912. Vent collapse generally does not occur without a compression force "F". FIGS. 9C–E show how vapor path 912 is closed off as aseptic closure portion 908 and body portion 910 are brought together.

Figure 9F:
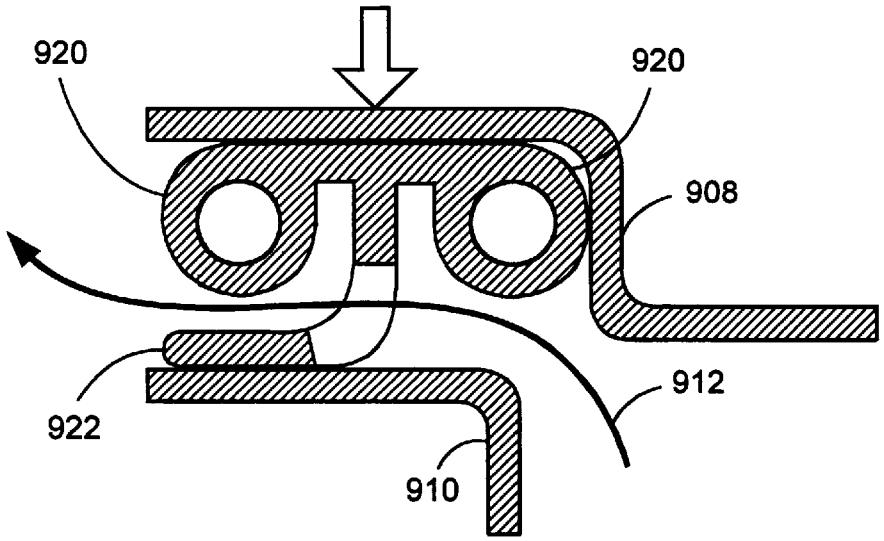
Figure 9G:
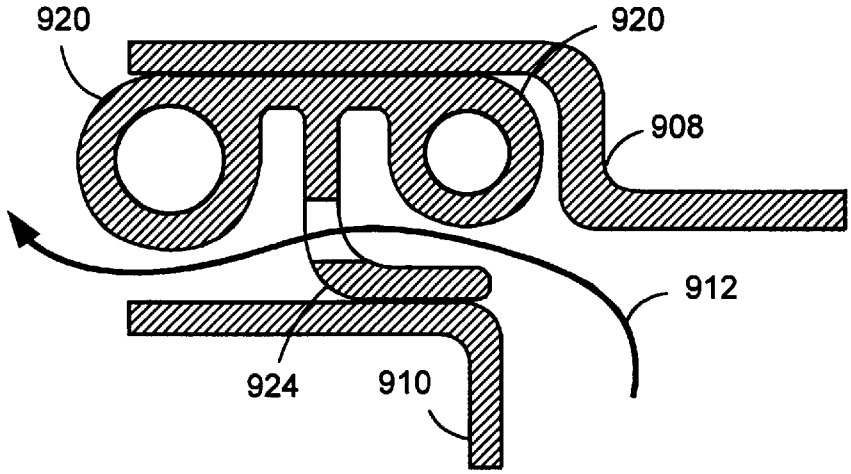
Figure 9H:
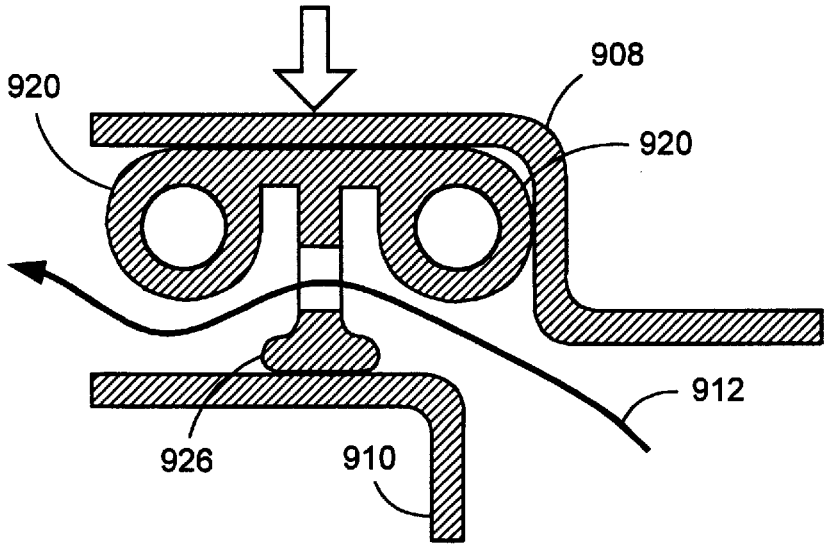

FIGS. 9F–H show cross sections of different embodiments of edge sealing gaskets according to the invention. Shown are aseptic closure portion 908, body portion 910, bi-lobe sealing elements 920, first tab 922, second tab 924, and third tab 926. The bi-lobes of the bi-lobe sealing elements 920 may be arranged such that they straddle a tab designed to permit vapor flow through vapor path 912 to pass through the tab. The tab arrangement may vary according to various design considerations. For example, first tab 922 may extend towards an outside surface of the bulk lyophilization container. Alternatively, second tab 924 may extend towards an inside surface of the bulk lyophilization container. Finally, third tab 926 may be designed such that it may collapse between the bi-lobes of bi-lobe sealing elements 920. In each of these embodiments, when bi-lobes of bi-lobe sealing elements 920 are under compression between aseptic closure portion 908 and body portion 910, they serve to form a seal, both inner and outer, against possible contamination or leakage.

Figure 9I:
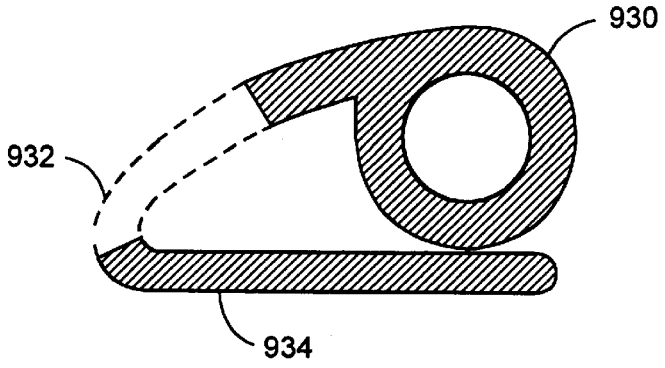
Figure 9J:
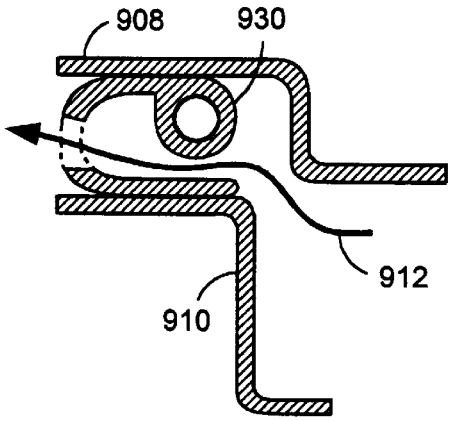
Figure 9K:
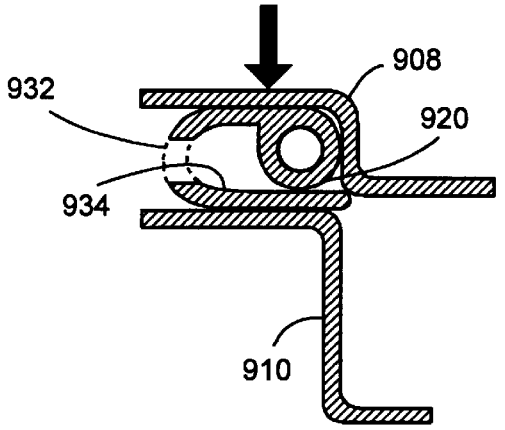
Figure 9L:
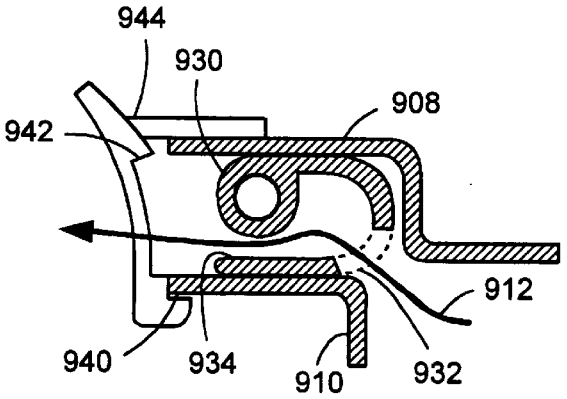
Figure 9M:
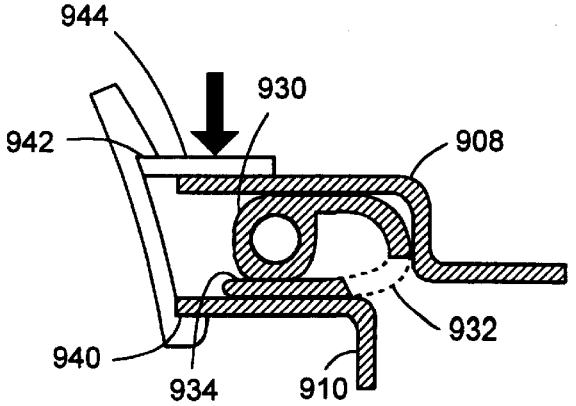

FIGS. 9I–M show cross-sections of different embodiments of edge sealing gaskets according to the invention. Shown are edge sealing elements 930, vapor vent 932, and tab 934. FIG. 9G shows these elements in relation to one another in an embodiment of the invention. FIGS. 9H–I show these elements in relation to aseptic closure portion 908 and body portion 910. When aseptic closure portion 908 and body portion 910 do not compress the edge sealing gasket according to the invention, vapor may exit along vapor path 912 during lyophilization. Following lyophilization, aseptic closure portion 908 and body portion 910 may be moved together as indicated in FIG. 9I, compressing edge sealing elements 930 and interrupting vapor path 912. FIGS. 9J–K show an alternative embodiment, wherein aseptic closure portion fasteners are used to maintain compression of edge sealing elements 930. Movable member 944 may be moved downward to first notch 942, which it then engages. Once engaged, movable member 944 holds aseptic closure portion 908 and second notch 940 holds body portion 910 such that edge sealing elements 930 are under compression. This cuts off vapor path 912, as is shown by comparison between FIGS. 9J and 9K.

Figure 10:
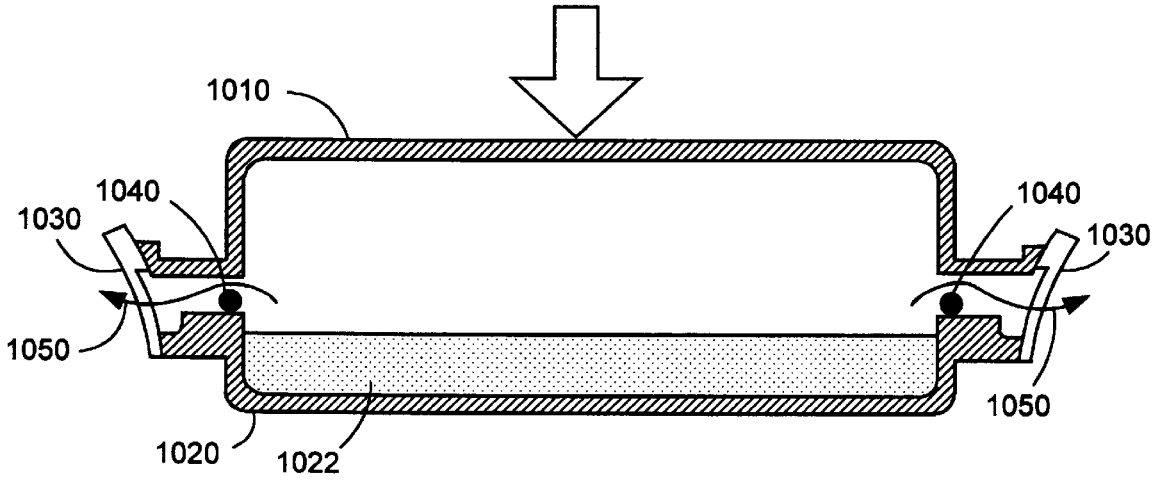
FIG. 10 shows a cross-section of a bulk lyophilization container according to the invention.

FIG. 10 shows an exemplary embodiment of aseptic closure portion fasteners for use with bulk lyophilization containers according to the present invention. FIGS. 10A–10C show aseptic closure portion 1010, body portion 1020, product 1022, fastener 1030, edge sealing element 1040 and vapor path 1050. Fastener 1030 functions by holding together aseptic closure portion 1010 and body portion 1020 so as to keep edge sealing element under compression. When fastener 1030 does not hold together aseptic closure portion 1010 and body portion 1020, vapor may travel along vapor path 1050, thus facilitating lyophilization. When fastener 1030 holds together aseptic closure portion 1010 and body portion 1020, vapor travel along vapor path 1050 is blocked.

Figure 11A:
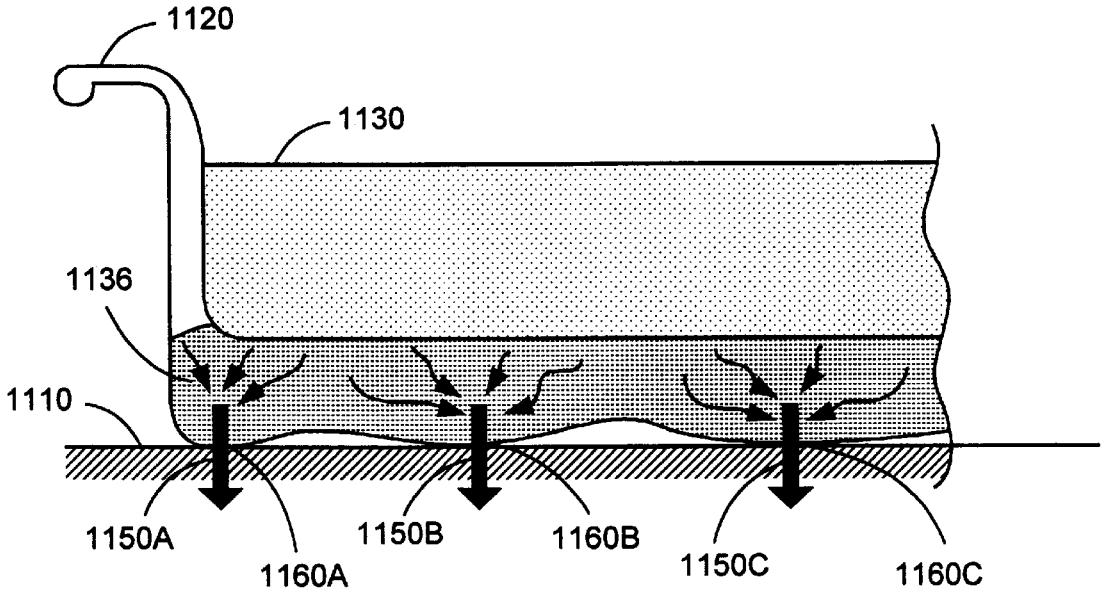
FIG. 11A shows a cross-section of lyophilization container on a shelf lyophilizer.

FIG. 11A illustrates the problem of heat flux management in a bulk lyophilization system. In FIG. 11A, shelf 1110, body portion 1120, product 1130, heat conductor element 1136, heat flux vectors 1150A–C and contact points 1160A–C are illustrated. In the process of bulk lyophilization, it is necessary that be removed from and added to product 1130. These heat fluxes are effectuated primarily through conductive heat transfer between product 1130 and shelf 1110 via heat conductor element 1136, of which body portion 1120 is comprised. In the course of repeated use, body portion 1120 and shelf 1110 do not remain planar and have a irregular mating surface with respect to one another. Typically, body portion 1120 will contact the shelf at a finite number of contact points, such as depicted by contact points 1160A–C. Variations in the heat flux vectors 1150 (either from the body portion to the shelf or from the shelf to the body portion) occur across the base of the product receptacle because the mating between the shelf and the body portion is irregular.

To improve product quality and product uniformity, it is desirable to make uniform the heat flux from and to the product. The uniformity of heat transfer between the cooled/heated shelf of the lyophilizer and the product is of significance during freezing prior to lyophilization and during primary and secondary drying. During initial cooling and freezing, the uniform heat flux between the container wall facing the product and the product itself may determine the pattern of growing ice crystals, e.g. the pattern of ice crystals inside the frozen product matrix. Such a uniform heat flux may prevent local overcooling and localized initiation of ice crystal growth. The frozen matrix of ice crystals and product/solutes glassy states and eutectics between the ice crystals may determine the ice sublimation uniformity and the product/solutes matrix after the sublimation of ice step. In short, uniform heat flux during freezing may deliver uniform ice crystal matrix and uniform distribution of product and solutes between the ice crystals.

Uniform ice crystal structure tends to lead to uniform sublimation (sublimation ends at the same time for all areas of the container) and the resulting structure of the product and solutes solid therefore also may be uniform. Such uniform structure may permit uniform removal of the water/solvent from that matrix during secondary drying. Uniform heat flux may be helpful during secondary drying to reduce local overheating of the matrix (local overheating of the matrix may cause product softening in those areas, potentially leading to localized matrix collapse). Therefore, very uniform heat flux may be beneficial to the process during cooling, freezing, and primary and secondary drying.

As the contact between the cooling/heating shelf may not be uniform, thermal conductor element 1136 in the container bottom redistributes the heat flux and makes it more uniform on the product contact side.

Figure 11B:
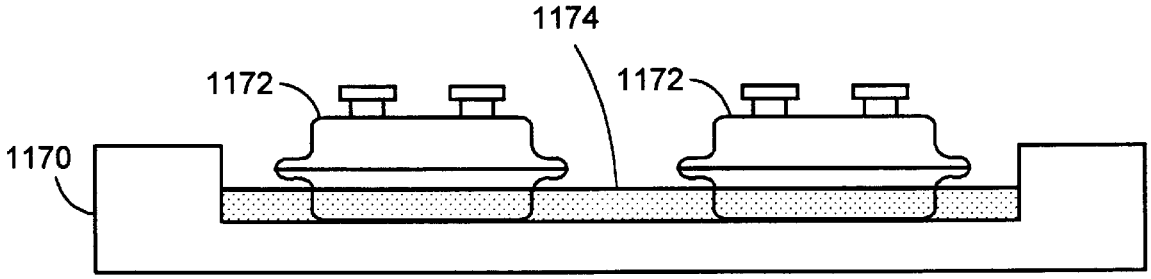
FIG. 11B shows a side elevation of lyophilization containers in a heat transfer bath.

FIG. 11B shows one way of making the heat flux between a shelf and the product more uniform. Shown are shelf 1170, containing bulk lyophilization containers 1172, and liquid heat transfer media 1174. Liquid heat transfer media 1174 conforms to the surface of both shelf 1170 and bulk lyophilization containers 1172, thus making more uniform the heat transfer. However, this arrangement may create cleaning and contamination problems, due to the presence of liquid heat transfer media 1174 on the outside of bulk lyophilization containers 1172 and associated droplets and spills.

Figure 12A:
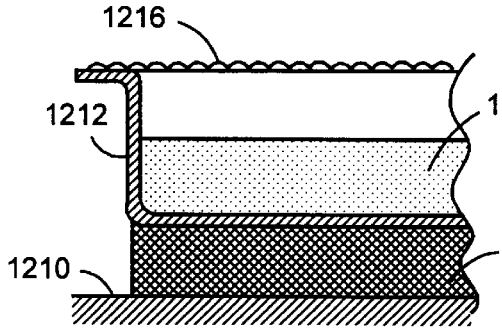
FIGS. 12A–F show cross-sections of bulk lyophilization containers according to the invention.

FIGS. 12A–F show exemplary embodiments of heat flux management for bulk lyophilization containers according to the present invention. FIG. 12A shows shelf 1210, body portion 1212, product 1214, aseptic closure portion 1216, and heat flux equalizer portion 1218. Enclosed by body portion 1212 and aseptic closure portion 1216 is product 1214. Located on a bottom surface of body portion 1212 is heat flux equalizer portion 1218. Heat flux equalizer portion 1218 improves the uniformity of the heat flux to the product 1214 from the shelf 1210 by virtue of relatively rapid isotropic heat conduction within heat flux equalizer portion 1218. Heat flux equalizer portion 1218 is desirably located between product 1214 and shelf 1210. Heat flux equalizing portions according to the invention may comprise a variety of materials, including phase change materials, and thermally conductive solid materials. Examples of thermally conductive solid materials include, but are not limited to, thermally conductive metals such as copper, aluminum, stainless steel, corrosion-resistant alloys, and titanium etc, and thermally conductive polymers. The thickness and attachment of such materials may be varied to improve the heat flux equalization imparted. The heat flux equalizer according to the invention may equalize heat flux in three dimensions, serving to provide both vertical and horizontal equalizing with respect to a shelf or tray of a tray lyophilizer. Further, the heat flux equalizing portion may possess linear or nonlinear heat flux or temperature change characteristics. Nonlinearities may be represented as a single curve in a plot of product temperature or heat flux to the product versus time or input heat flux. Nonlinearities may be represented as multiple curves, and therefore may exhibit hysteresis.

Figure 12B:
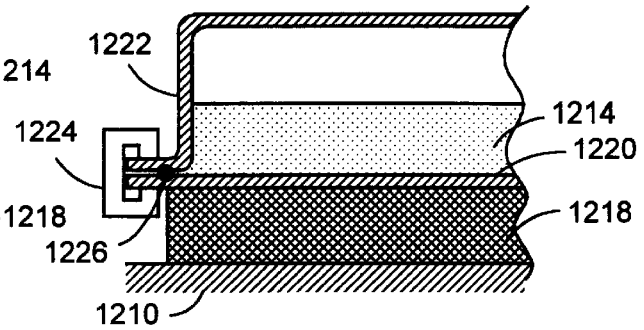

FIG. 12B shows an alternate embodiment of the heat flux management according to the present invention including shelf 1210, body portion 1220, product 1214, heat flux equalizer portion 1218, aseptic closure portion 1222, clamp 1224, and seal 1226. Clamp 1224 and seal 1226 serve to keep body portion 1212 and aseptic closure portion 1222 together so as to contain product 1214. Heat flux equalizer portion 1218 improves the uniformity of the heat flux to the product 1214 from the shelf 1210 by virtue of relatively rapid isotropic heat conduction within heat flux equalizer portion 1218.

Figure 12C:
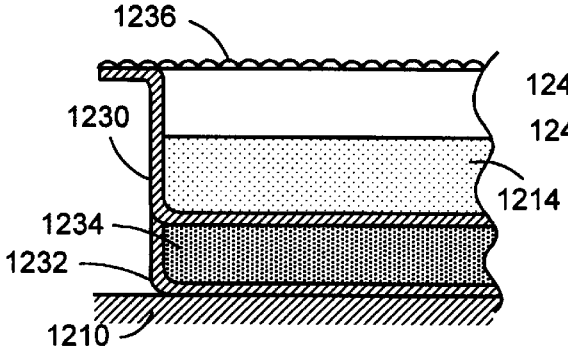

FIG. 12C shows an alternate embodiment of the heat flux management according to the present invention including shelf 1210, body portion 1230, phase change material 1234, phase change material container 1232, product 1214, and aseptic closure portion 1236. Enclosed by body portion 1230 and aseptic closure portion 1236 is product 1214. Located on a bottom surface of body portion 1230 is phase change material 1234, which may be enclosed or encapsulated by phase change material container 1232. Phase change material 1234 represents a particular embodiment of a heat flux equalizer portion.

Phase change material 1234 may be such that it creates plateaus in the variation of heat flux from shelf 1210 to product 1214 versus time. The plateaus occur at a temperature range characteristic of the phase change material. There are a variety of phase change materials that may be enclosed by the phase change material container. In a preferable embodiment, the phase change material may have a transition temperature slightly below zero deg C. to reduce liquid undercooling during initial freezing, by slowing down the temperature decrease (e.g. providing a temperature plateau to equilibrate the product solution).

The phase change temperature may be also selected near the eutectic and glass transition temperatures where heat capacity of the matrix changes to absorb those changes and reduce sudden product temperature changes in those zones. This may make the transition smooth without product overheating, thus reducing the likelihood of resulting matrix softening and collapse, e.g., product thermal protection. The phase change material may absorb/supply additional heat flux over a narrow temperature range, for example, by melting, solidification or sublimation and vice versa. The phase change material thus may provide a way of thermal management and protection of product matrix in the transitional zones (with changing properties of product and solutes) where steady heat flux may cause sudden temperature changes.

The enclosed phase change material may include aqueous solutions (salts, molecular species), paraffins, gels, organic fluids, emulsions, etc. Preferably, such materials are encapsulated and sealed, thus reducing the possibility of leakage into the product. Expansion and contraction of these materials may be accommodated by providing side pockets on the tray circumference reaching beyond the product contact perimeter (e.g. without affecting the passage for the heat flux shelf-tray structure-product).

Figure 12D:
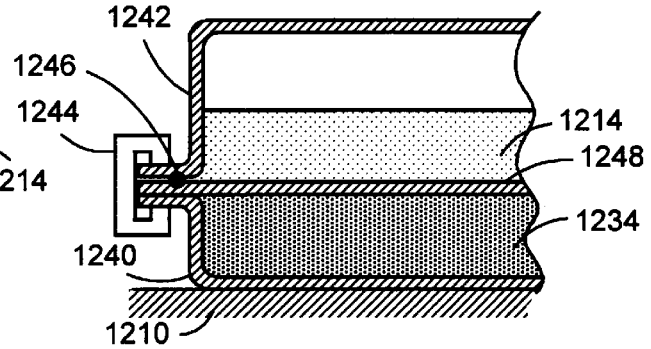

FIG. 12D shows an alternate embodiment of the heat flux management according to the present invention including shelf 1210, body portion 1248, product 1214, phase change material 1234, phase change material container 1240, aseptic closure portion 1242, clamp 1244, and seal 1246. Clamp 1244 and seal 1246 serve to keep body portion 1248 and aseptic closure portion 1242 together so as to contain product 1214. Located on a bottom surface of body portion 1248 is phase change material 1234, which is enclosed by phase change material container 1240. Phase change material 1234 is such that it creates plateaus in the variation of heat flux from shelf 1210 to product 1214 versus time, as discussed above.

Figure 12E:
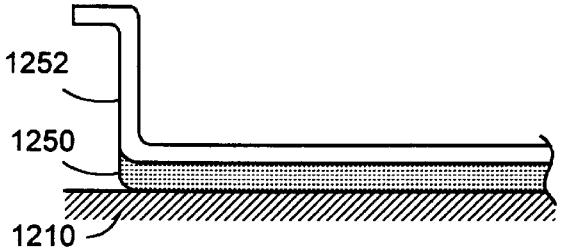
Figure 12F:
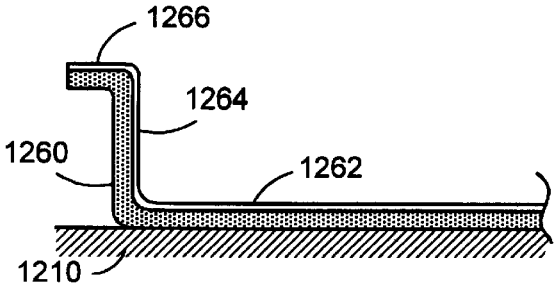

FIGS. 12E–F show different arrangements of heat flux equalizer portions on bulk lyophilization containers according to the invention. In FIG. 12E, heat flux equalizer portion 1250 is coupled to the bottom of body portion 1252 and is located between body portion 1252 and shelf 1210. In FIG. 12F, heat flux equalizer portion 1260 is coupled to the bottom of body portion 1262 and is also coupled to the side 1264 and lip 1266 of body portion 1262. This facilitates even heating along the bottom, and sides of product contained within the bulk lyophilization container. It may also facilitate tray manufacturing.

Figure 13A:
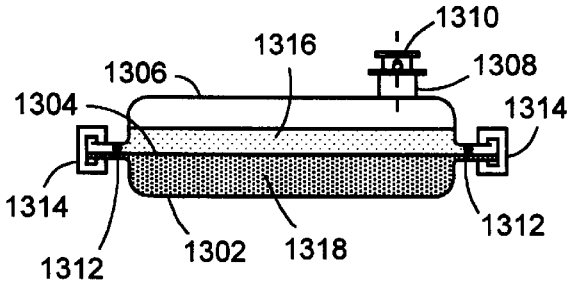
FIGS. 13A–C show cross-sections of bulk lyophilization containers according to the invention.
Figure 13B:
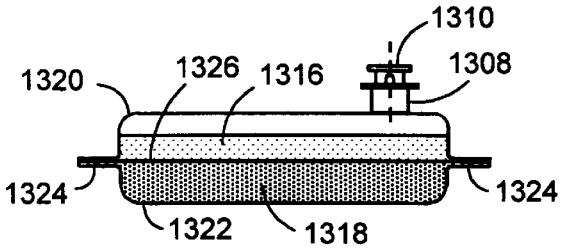
Figure 13C:
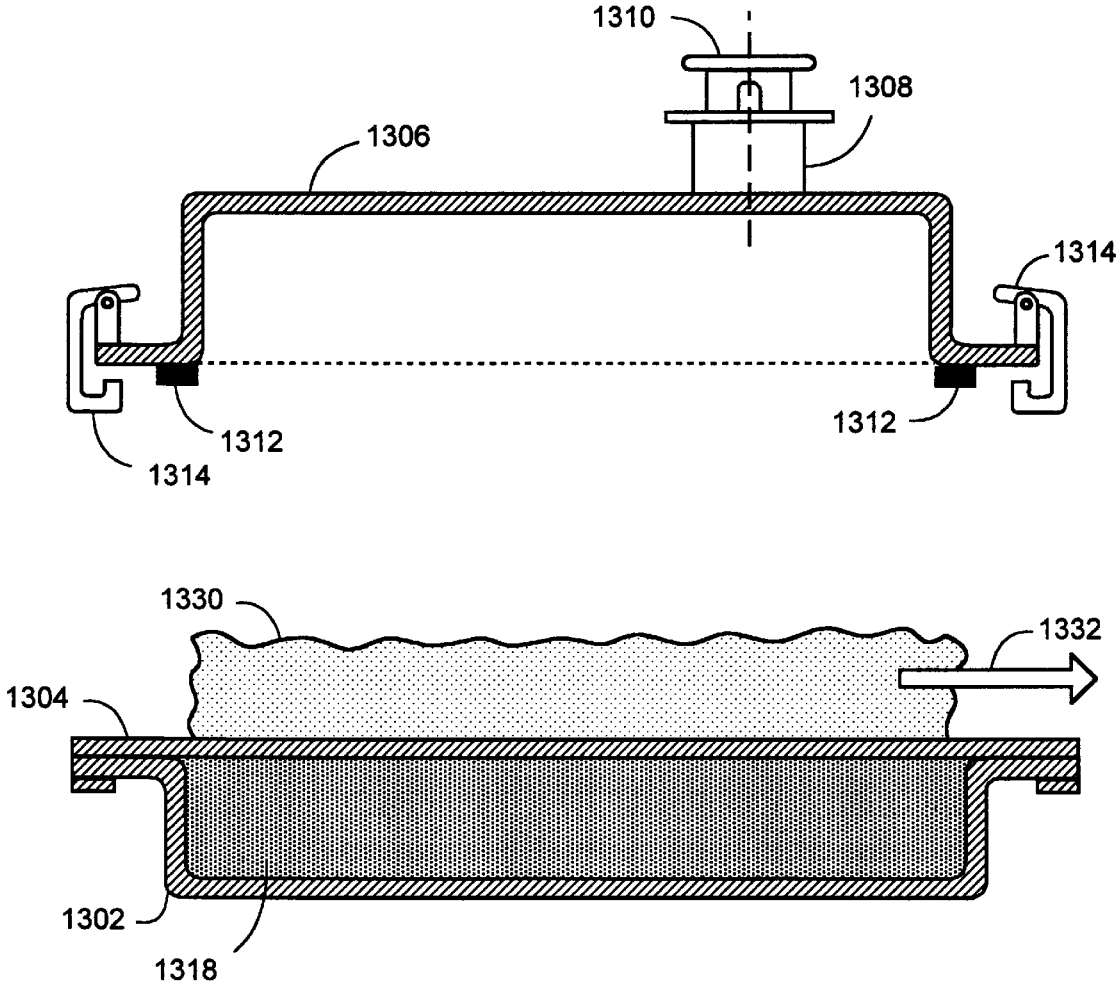

FIGS. 13A–C show cross-sections of bulk lyophilization containers according to the invention. In FIG. 13A are shown body portion 1304, neck 1308, stopper 1310, product 1316, phase change material 1318, phase change material container 1302, aseptic closure portion 1306, clamps 1314, and seals 1312. Clamps 1314 and seals 1312 serve to keep body portion 1304 and aseptic closure portion 1306 together so as to contain product 1316. Stopper 1310 is located in neck 1308, and permits vapor to flow through during lyophilization and may seal the neck following lyophilization. Located on a bottom surface of body portion 1304 is phase change material 1318, which is enclosed by phase change material container 1302. Phase change material 1318 is such that it creates plateaus in the variation of heat flux across its thickness to product 1316 versus time. The plateaus occur at a temperature range characteristic of the phase change material, as discussed above.

FIG. 13B shows a cross section of an alternative embodiment of a bulk lyophilization container according to the invention. Shown are body portion 1326, product 1316, phase change material 1318, phase change material container 1322, aseptic closure portion 1320, and sealing portions 1324. Sealing portions 1324 serve to keep body portion 1326 and aseptic closure portion 1320 together so as to contain product 1316. In this embodiment, sealing portions 1324 are designed such that they are semi-permanent in nature, and are less easily removed than clamp-based seals, for example. Located on a bottom surface of body portion 1326 is phase change material 1318, which is enclosed by phase change material container 1322. Phase change material 1318 is such that it creates plateaus in the variation of heat flux across its thickness to product 1316 versus time. The plateaus occur at a temperature range characteristic of the phase change material, as discussed above.

FIG. 13C is an expanded cross-sectional view of the bulk lyophilization container of FIG. 13A. The components, their structure and function are identical to the bulk lyophilization container of FIG. 13A, with the exception that lyophilized product 1330 is shown on body portion 1304. Lyophilized product 1330 may be removed from body portion 1304 by sweeping or scraping it, for example, in the direction indicated by arrow 1332 as the surface may be substantially flat.

Figure 14A:
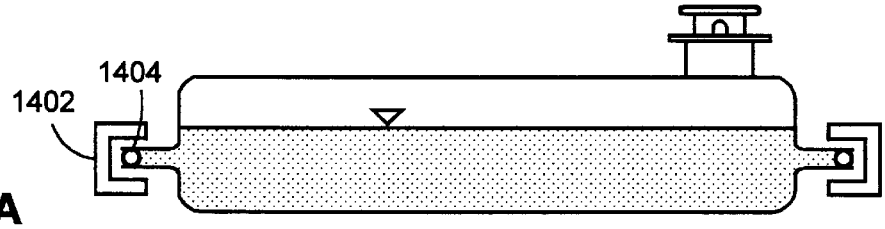
FIGS. 14A–H show cross-sections of bulk lyophilization containers according to the invention, emphasizing their sealing arrangements.
Figure 14B:
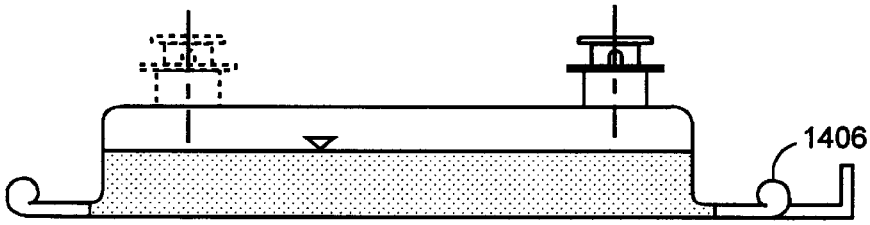
Figure 14C:
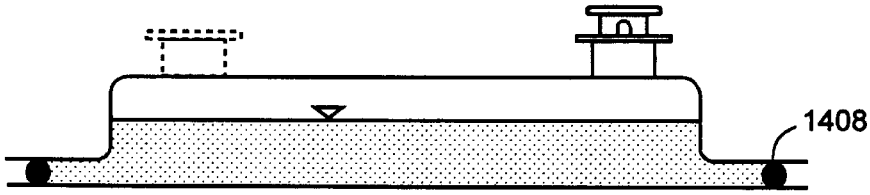
Figure 14D:
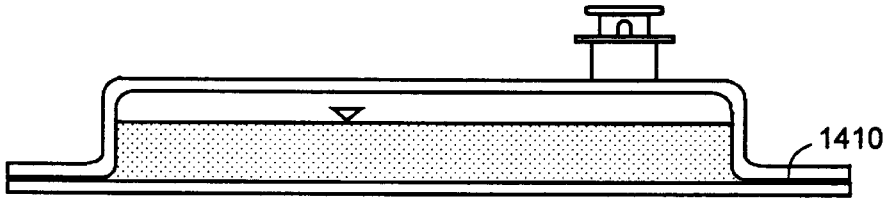
Figure 14E:
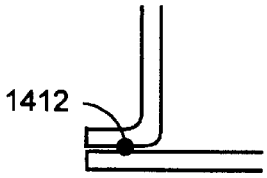
Figure 14F:
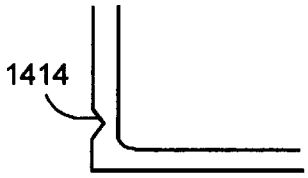
Figure 14G:
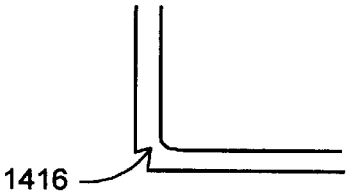
Figure 14H:
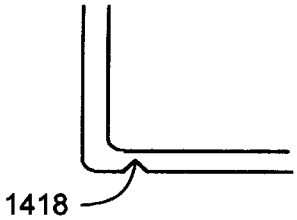

FIGS. 14A–H show cross-sectional views of different sealing arrangements for bulk lyophilization containers according to the invention. Each seal serves to keep together the body portion and the aseptic closure portion. FIG. 14A shows seals formed by clamps 1402 and o-rings 1404. FIG. 14B shows seals formed by removable foil 1406. FIG. 14C shows seals 1408 formed by thermoforming processes, such as those involving rolling and compressing. Such seals 1408 may be formed by heat sealing of polymers or heat sealing of multilayer materials, for example a foil or metal sheet covered with a thermosealing layer. Seals 1408 may also be made using pressure-sensitive sealants, or heat and compression techniques. FIG. 14D shows single-use seals 1410. Various types of these single-use seals are shown in enlarged detail in FIGS. 14E–H. Shown in FIG. 14E is tack-welded seal 1412. Shown in FIG. 14F is notched wall seal 1414. Shown in FIG. 14G is notched corner seal 1416. Shown in FIG. 1418 is notched bottom seal 1418. A notched design may provide improved bottom removal for product emptying from single-use trays.

Figure 15A:
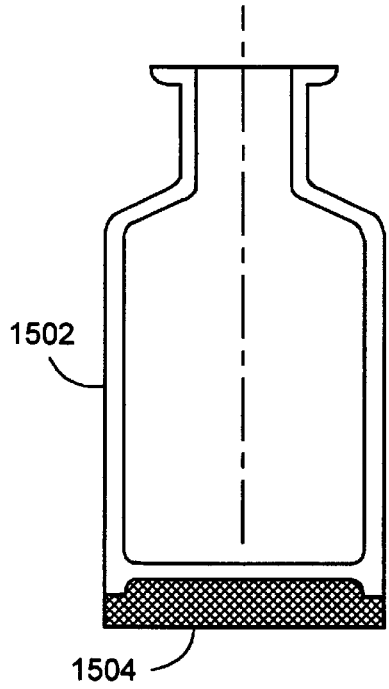
FIGS. 15A–E show cross-sections of lyophilization containers according to the invention, emphasizing their heat flux equalizing portions.
Figure 15B:
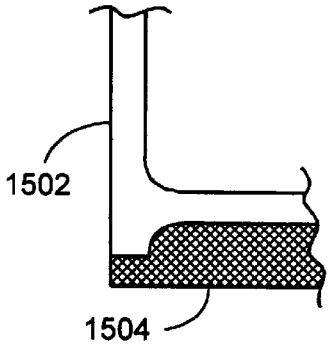
Figure 15C:
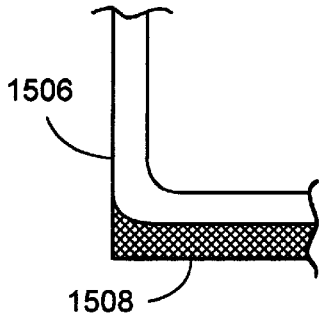
Figure 15D:
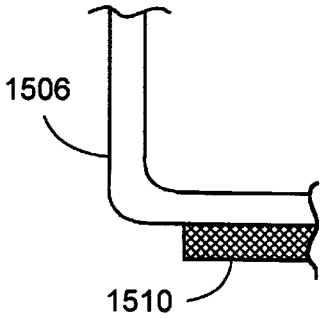
Figure 15E:
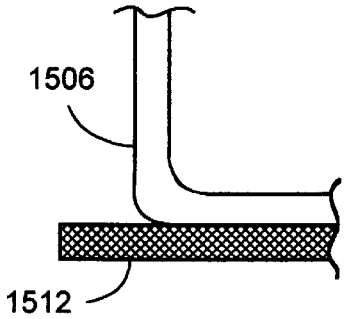

FIGS. 15A–E show cross-sections of lyophilization vials using heat flux equalizer portion according to the invention. These embodiments show that the heat flux equalizer portions may be applied to conventional lyophilization vials or containers with improved lyophilization results. FIG. 15A shows a cross-section of conventional lyophilization vial or container 1502 coupled to heat flux equalizer portion 1504. Heat flux equalizer portion 1504 possesses a thickness sufficient to improve the uniformity of the heat flux across its thickness. FIG. 15B shows an expanded view of a portion of the embodiment shown in FIG. 15A. FIG. 15C shows a cross-sectional view of another embodiment, showing a different arrangement of conventional lyophilization vial or container 1506 coupled to heat flux equalizer portion 1508. FIG. 15D shows a cross-sectional view of another embodiment, showing a different arrangement of conventional lyophilization vial or container 1506 coupled to heat flux equalizer portion 1510. FIG. 15E shows a cross-sectional view of another embodiment, showing a different arrangement of conventional lyophilization vial or container 1506 coupled to heat flux equalizer portion 1512. These reduced or expanded areas of thermal conductor may depend on the type of the container wall used to compensate for differences in thermal conductivity between the product and the material of container wall. Good contact between the container/vial bottom material and high thermal conductivity layer is preferable, e.g. there preferably are few to no gaps/crevices there. In a more preferable embodiment, the container wall and the high thermal conductivity layer of the heat flux equalizer portion may be fused. The vial production process may be mass-automated to include permanent attachment of the bottom equalizer.

It will be apparent to those skilled in the art that various modifications and variations can be made in the lyophilization apparatus and methods of the present invention without departing from the spirit or scope of the invention. Thus, it is intended that the present invention cover the modifications and variations of this invention provided they come within the scope of the appended claims and their equivalents.

What is claimed is:

1. A bulk lyophilization container comprising:

a body portion; and an aseptic closure portion, wherein the body portion is coupled to the aseptic closure portion; and the aseptic closure portion comprising an impervious membrane detachably coupled to the body portion via a membrane seal, wherein the impervious membrane may be detached from the body portion by tearing the membrane.

2. A bulk lyophilization container comprising; a body portion;

an aseptic closure portion; and at least two filling/ventilating necks;

wherein the body portion is detachably coupled to the aseptic closure portion, thereby facilitating removal of lyophilized product after lyophilization.

3. The bulk lyophilization container of claim 2, wherein the aseptic closure portion is detachably coupled to the body portion by at least one mechanical clamp.

4. A bulk lyophilization container comprising:

a body portion; and an aseptic closure portion, wherein the body portion is coupled to the aseptic closure portion and the aseptic closure portion comprises a sealable neck, and the sealable neck capable of being sealed after lyophilization of a product contained in the bulk lyophilization container.

5. A bulk lyophilization container comprising:

a body portion; and an aseptic closure portion, wherein the body portion is non-detachably coupled to the aseptic closure portion and wherein the bulk lyophilization container is stiff thereby improving lyophilization of a product contained in the bulk lyophilization container.

6. A bulk lyophilization container comprising:

a body portion;

an aseptic closure portion; and at least one filling/ventilating neck, wherein the at least one filling/ventilating neck is mechanically reinforced to facilitate filling of a product or ventilation of vapors during lyophilization; and wherein the body portion is coupled to the aseptic closure portion.

7. A bulk lyophilization container comprising:

a body portion;

an aseptic closure portion; and at least one filling/ventilating neck; and wherein the body portion is coupled to the aseptic closure portion, and the container is stiff thereby improving lyophilization of a product contained in the bulk lyophilization container.

8. A bulk lyophilization container comprising:

a body portion; and an aseptic closure portion, wherein the body portion is coupled to the aseptic closure portion, and the bulk lyophilization container being stiff thereby improving lyophilization of a product contained in the bulk lyophilization container and the bulk lyophilization container possessing a geometric shape suitable for compact storage.

9. The bulk lyophilization container of claim 8, wherein the geometic shape includes a circular, triangular, elliptical, quadrilaterial, pentagonal, or hexagonal shape.

10. An array comprising bulk lyophilization containers, wherein the bulk lyophilization containers comprise:

a body portion; and an aseptic closure portion;

wherein the body portion is coupled to the aseptic closure portion, and the bulk lyophilization container being stiff thereby improving lyophilization of a product contained in the bulk lyophilization container and the bulk lyophilization container possessing a geometric shape suitable for compact storage.

11. A method of storing lyophilized material, comprising:

storing the lyophilized material in bulk lyophilization containers;

wherein the bulk lyophilization containers comprise a body portion; and an aseptic closure portion; wherein the body portion is coupled to the aseptic closure portion, and the bulk lyophilization container being stiff thereby improving lyophilization of a product contained in the bulk lyophilization container and the bulk lyophilization container possessing a geometric shape suitable for compact storage.

12. A bulk lyophilization container comprising:

a body portion;

an aseptic closure portion; and alignment or supporting aids coupled to the bulk lyophilization container;

wherein the body portion is coupled to the aseptic closure portion and the bulk lyophilization container being stiff thereby improving lyophilization of a product contained in the bulk lyophilization container.

13. The bulk lyophilization container of claim 12, wherein the alignment and support aids comprise edge support/alignment elements, support/alignment pins or raised center portions.

14. A bulk lyophilization container comprising:

a body portion;

an aseptic closure portion; and optional liquid ports coupled to the bulk lyophilization container to facilitate addition or removal of liquid after lyophilization;

wherein the body portion is coupled to the aseptic closure portion.

15. A bulk lyophilization container comprising:

a body portion; and an aseptic closure portion, wherein the body portion is coupled to the aseptic closure portion via seals comprising seals formed by clamps and o-rings thereby facilitating removal of lyophilized product from the bulk lyophilization container following lyophilizaton.

16. A bulk lyophilization container comprising:

a body portion; and an aseptic closure portion;

wherein the body portion is coupled to the aseptic closure portion via seals comprising seals formed by removable foil, thermoforming, heat sealing of polymers or heat sealing of multilayer materials, pressure-sensitive sealants, heat and compression techniques, or single-use seals.

17. The bulk lyophilization container of claim 16, wherein the single-use seals comprise a tack-welded seal, a notched wall seal, a notched corner seal, or a notched bottom seal.

18. A bulk lyophilization container comprising:

a body portion;

an aseptic closure portion; and an edge sealing element coupled to tabs;

wherein the tabs and the edge sealing element define edge vents such that the edge vents provide a path for vapor to travel through during lyophilization, and wherein the aseptic closure portion and the body portion are coupled via the edge sealing element coupled to the tabs, and wherein the edge sealing element serves to form a seal between the aseptic closure portion and the body portion when the aseptic closure portion and the body portion are compressed together.

19. A bulk lyophilization container comprising:

a body portion;

an aseptic closure portion; and a bi-lobe sealing element coupled to tabs;

wherein the tabs are designed to permit vapor flow to pass through or around the tabs during lyophilization, and wherein the aseptic closure portion and the body portion are coupled via the bi-lobe sealing element coupled to the tabs, and wherein the bi-lobe sealing element serves to form a seal between the aseptic closure portion and the body portion when the aseptic closure portion and the body portion are compressed together.

20. The bulk lyophilization container of claim 19, wherein the tabs extend towards an outer surface of the bulk lyophilization container.

21. The bulk lyophilization container of claim 20, wherein the tabs extend towards an inner surface of the bulk lyophilization container.

22. The bulk lyophilization container of claim 21, wherein the tabs are arranged such that they collapse between bi-lobes of the bi-lobe sealing elements.

23. A bulk lyophilization container comprising:

a flat body portion wherein the flat body portion facilitates removal of lyophilized product from the bulk lyophilization container following lyophilization; and an aseptic closure portion;

wherein the body portion is coupled to the aseptic closure portion.

24. A bulk lyophilization container comprising:

a body portion; and a flat aseptic closure portion wherein the flat aseptic closure portion facilitates removal of lyophilized product from the bulk lyophilization container following lyophilization;

wherein the body portion is coupled to the aseptic closure portion.

* * * * *